United States Patent [19]

Ohmura et al.

[11] Patent Number: 4,906,531

[45] Date of Patent: Mar. 6, 1990

[54] ALLOYS STRENGTHENED BY DISPERSION OF PARTICLES OF A METAL AND AN INTERMETALLIC COMPOUND AND A PROCESS FOR PRODUCING SUCH ALLOYS

[75] Inventors: Hiroyuki Ohmura, Tokyo, Japan; Morris E. Fine, Wilmette, Ill.; Takao Miyoshi, Tokyo, Japan

[73] Assignee: Ryobi Limited, Hiroshima, Japan

[21] Appl. No.: 103,125

[22] Filed: Sep. 30, 1987

[30] Foreign Application Priority Data

| | | | |
|---|---|---|---|
| Oct. 1, 1986 | [JP] | Japan | 61-235401 |
| Dec. 26, 1986 | [JP] | Japan | 61-313715 |
| Jul. 30, 1987 | [JP] | Japan | 62-191411 |

[51] Int. Cl.[4] ..... C22C 21/00

[52] U.S. Cl. ..... 428/614; 148/415; 148/440

[58] Field of Search ..... 420/547, 550; 148/415, 148/439, 440; 428/614

[56] References Cited

U.S. PATENT DOCUMENTS

| | | | |
|---|---|---|---|
| 4,021,271 | 5/1977 | Roberts | 148/440 |
| 4,080,222 | 3/1978 | Schoerner et al. | 148/440 |
| 4,471,032 | 9/1984 | Fukuoka et al. | 148/415 |

FOREIGN PATENT DOCUMENTS

| | | | |
|---|---|---|---|
| 0047543 | 4/1981 | Japan | 420/550 |
| 0013046 | 1/1985 | Japan | 420/550 |
| 0052546 | 3/1985 | Japan | 420/550 |

*Primary Examiner*—L. Dewayne Rutledge
*Assistant Examiner*—David W. Schumaker
*Attorney, Agent, or Firm*—Finnegan, Henderson, Farabow, Garrett and Dunner

[57] ABSTRACT

A matrix of an Al-Ni base alloy or an Al-Si-Cu base alloy is strengthened by dispersion of particles of Ni, Si or at least one intermetallic compound selected from among AlNi, $Al_3Ni$, $Al_3Ni_2$ and $AlNi_3$.

12 Claims, 29 Drawing Sheets

(x50)

(x50)

(x50)

○ : Aℓ-Ni
■ : 15wt.% AℓNi/Aℓ-Ni
◑ : 20wt.% AℓNi/Aℓ-Ni
△ : 30wt.% AℓNi/Aℓ-Ni
◐ : 40wt.% AℓNi/Aℓ-Ni 10 wt% AℓNi/Aℓ-6.0 wt% Ni AT MOLD TIP
(x50)

10wt%AℓNi/Aℓ-6.0wt%Ni AT POURING GATE
(x50)

AℓNi PARTICLES BEFORE ADDITION
(x50)

10wt% Ni / Aℓ-7wt% Ni-5wt% Mg
(x50)

AMOUNT OF SPECIFIC WEAR AGAINST ROTARY DISK FC25

AMOUNT OF SPECIFIC WEAR AGAINST ROTARY DISK SUJ2

10wt% $Al_3Ni$ / Al-8wt% Si-3wt% Cu
(x50)

10wt% AlNi / Al-8wt% Si-3wt% Cu
(x50)

10wt% $A\ell Ni_3$ / $A\ell$-8wt% Si-3wt% Cu
(x50)

10wt% Si / $A\ell$-8wt% Si-3wt% Cu
(x50)

10wt% $Al_3Ni$ / Al-19wt% Si-7wt% Cu
(x50)

10wt% AlNi / Al-19wt% Si-7wt% Cu
(x50)

10 wt% $AlNi_3$ / Al-19 wt% Si-7 wt% Cu
(x50)

10 wt% Si / Al-19 wt% Si-7 wt% Cu
(x50)

AMOUNT OF SPECIFIC WEAR AGAINST ROTARY DISK FC25

WEAR RESISTANCE OF $Al_3Ni$ / Al-15wt%Si-4wt%Cu

AMOUNT OF SPECIFIC WEAR AGAINST ROTARY DISK FC25

WEAR RESISTANCE OF $Al_3Ni$ / Al-19wt%Si-7wt%Cu

AMOUNT OF SPECIFIC WEAR AGAINST ROTARY DISK FC25

WEAR RESISTANCE OF AℓNi / Aℓ-8 wt%Si-3wt%Cu

AMOUNT OF SPECIFIC WEAR AGAINST ROTARY DISK FC25

WEAR RESISTANCE OF AℓNi / Aℓ-15wt%Si-4wt%Cu

AMOUNT OF SPECIFIC WEAR AGAINST ROTARY DISK FC25

WEAR RESISTANCE OF AℓNi / Aℓ-19wt%Si-7wt%Cu

AMOUNT OF SPECIFIC WEAR AGAINST ROTARY DISK FC25

WEAR RESISTANCE OF AℓNi3 / Aℓ-8wt%Si-3wt%Cu

AMOUNT OF SPECIFIC WEAR AGAINST ROTARY DISK FC25

WEAR RESISTANCE OF $A\ell Ni_3$ / $A\ell$-15wt%Si-4 wt%Cu

AMOUNT OF SPECIFIC WEAR AGAINST ROTARY DISK FC25

WEAR RESISTANCE OF AℓNi3 / Aℓ-19wt%Si-7wt%Cu

AMOUNT OF SPECIFIC WEAR AGAINST ROTARY DISK FC25

WEAR RESISTANCE OF Si/Aℓ-8wt%Si-3wt%Cu

AMOUNT OF SPECIFIC WEAR AGAINST ROTARY DISK FC25

WEAR RESISTANCE OF Si/Aℓ-15wt%Si-4wt%Cu

AMOUNT OF SPECIFIC WEAR AGAINST ROTARY DISK FC25

WEAR RESISTANCE OF Si/Aℓ-19wt%Si-7wt%Cu

AMOUNT OF SPECIFIC WEAR AGAINST ROTARY DISK FC25

ALLOYS STRENGTHENED BY DISPERSION OF PARTICLES OF A METAL AND AN INTERMETALLIC COMPOUND AND A PROCESS FOR PRODUCING SUCH ALLOYS

BACKGROUND OF THE INVENTION

The present invention relates to an alloy strengthened by dispersion of particles of a metal and an intermetallic compound. The present invention also relates to a process for producing such a dispersion-strengthened alloy.

Aluminum alloys are lightweight and have superior mechanical characteristics but they are not highly wear-resistant. There are two approaches to improve the wear resistance of aluminum alloys; one approach depends on working their surface and the other is directed to modifying the bulk material itself. One of the methods known in the art that belongs to the second approach comprises dispersing highly wear-resistant particles in the aluminum alloy.

Ni powder is an oxidation-resistant powder, and an Al-Ni base intermetallic compound powder is also resistant to oxidation and has a high degree of hardness. These powders have good affinity and hence good wettability with matrix materials of Al-Ni base alloy and exhibit high stability therein. Si powder is also resistant to oxidation and has a high degree of hardness. This powder has good wettability with matrix materials of Al-Si-Cu base alloy.

The Ni powder, Si powder and the intermetallic compound powder described above will dissolve very quickly when they are directly added to the melt of a prior art aluminum alloy such as an Al-Si base alloy or an Al-Si-Cu base alloy. Therefore, alloys strengthened by dispersion of particles of a metal and an intermetallic compound are conventionally produced by sintering techniques. In the sintering method conventionally employed, a metal powder or an intermetallic compound powder is added to the fine particles of a matrix forming metal, and the mix attained by mechanical agitation is pressed into a compact which then is sintered at elevated temperatures to produce a dispersion-hardened alloy strengthened by particles of the added metal or intermetallic compound. This alloy is subsequently fabricated into the final product either with an extruder or a rolling mill.

However, the conventional sintering technique has two serious problems. First, it is difficult to uniformly disperse the particles of a metal powder or an intermetallic compound powder in the powder of a matrix-forming mother alloy by mechanical agitation because the added particles will agglomerate and because they have a different specific gravity from the matrix particles. Secondly, in order to prevent the occurrence of oxidation which is accompanied with the pressing of the powder mix into a compact and subsequent sintering at elevated temperatures, an oxidation-preventing method and apparatus must be employed at the stage of sintering. This offers a certain constraint on the efforts to attain products having high dimensional accuracy and strength. Furthermore, the use of the oxidation-preventing apparatus considerably increases the overall cost of the process. Therefore, it has been difficult to produce large quantities of dispersion-hardened alloys at low cost by sintering techniques.

Under these circumstances, it has been desired to develop a dispersion-hardened alloy having superior mechanical properties that can be produced by a simple method and which has particles of a metal or an intermetallic compound dispersed quite uniformly in a mother alloy.

SUMMARY OF THE INVENTION

The present invention has been accomplished in order to solve the aforementioned problems of the prior art. Before the accomplishment of the present invention, it had generally been considered impossible to add a metal powder or an intermetallic compound powder directly to a molten mother alloy since the added powder would dissolve away. However, according to the present invention which employs a die-casting machine, a metal powder or an intermetallic compound powder can be directly added to a molten mother alloy and by means of performing mechanical agitation for a short period, the added particles can be uniformly dispersed in the matrix without being dissolved away. As a consequence, the mother alloy becomes dispersion-hardened by the particles of the added metal or intermetallic compound dispersed in the matrix and exhibits superior mechanical properties without suffering any decrease in ductility.

An object, therefore, of the present invention is to provide such an improved alloy strengthened by dispersion of particles of a metal or an intermetallic compound.

Another object of the present invention is to provide a process for producing this dispersion-hardened alloy.

The objects of the present invention can be attained by first adding Ni powder, Si powder, or an intermetallic compound powder directly to the melt of an Al-Ni base alloy or an Al-Si-Cu base alloy, then mixing under agitation, and subsequently die-casting the mixture to produce a dispersion-hardened alloy in which the particles of the added metal or intermetallic compound are uniformly dispersed in the matrix phase.

DETAILED DESCRIPTION OF THE PREFERRED EMBODIMENTS

Figure 1:
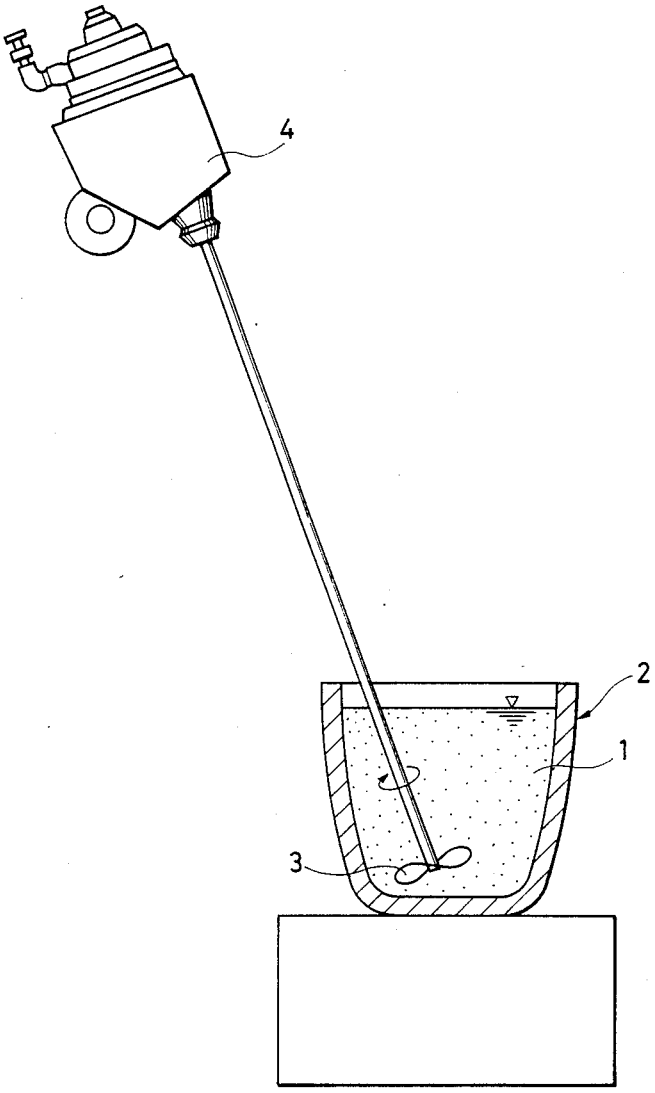
FIG. 1 is a partial cross section showing schematically an example of the mixer/stirrer that can be employed in producing the dispersion-hardened alloy of the present invention which is strengthened by particles of a metal or an intermetallic compound dispersed in the matrix.

Al-Ni base alloys are used in the present invention as the matrix of the dispersion-hardened alloy. So long as it is an aluminum alloy with a comparatively low Ni content, the matrix forming Al-Ni base alloy may contain any other alloying components. Preferred examples of the matrix forming Al-Ni base alloy are Al-Ni, Al-Ni-Mg, Al-Ni-Cu and Al-Ni-Zn base alloys, with and Al-Ni and Al-Ni-Mg alloys being more preferable. Particularly preferred examples are an Al-(3.5–8.0)wt % Ni alloy and an Al-(3.5–8.0)wt % Ni-(3.0–8.0)wt % Mg alloy.

These Al-Ni base alloys with low Ni contents are preferred matrix-forming materials since they have superior mechanical properties and are available at a reasonable cost. If the Ni content is less than 3.5 wt %, the desired mechanical properties are not attainable and if the Ni content exceeds 8.0 wt %, the matrix will have a reduced level of toughness. If the Mg content is less than 3.0 wt %, the desired strength will not be attained and if the Mg content exceeds 8.0 wt %, a marked drop in elongation will occur.

Al-Si-Cu base alloys may also be used as the matrix of the dispersion-hardened alloy of the present invention. A typical example of such alloy is an Al-Si-Cu alloy, specifically, an Al-(8–20)wt % Si-(2–9)wt % Cu is preferable. In addition, it is preferred that the alloy include additional components to improve its mechanical properties. The alloy should preferably contain 0.5–2.0 wt % Fe and 0.01–3.0 wt % Mg.

Al-Si-Cu base alloys are used in the present invention since these alloys have superior casting properties and mechanical properties and are advantageous in cost.

If the Si content of the Al-Si-Cu base alloy is less than 8 wt %, its mechanical properties are poor. Also, if the Si content exceeds 20 wt %, the mechanical properties deteriorate.

The particles to be dispersed in the matrix (which are hereinafter sometimes referred to as dispersed particles) are preferably those of a Ni powder, a Si powder or at least one intermetallic compound selected from amoung AlNi, $Al_3Ni$, $Al_3Ni_2$ and $AlNi_3$. These powders are used since they are wettable with the alloy of the matrix and are stable. As is clear from the Al-Ni phase diagram of FIG. 2, powders of Ni and of the intermetallic compounds listed above, which have good affinity for the Al-Ni base matrix forming alloys, are highly wettable with the layer and exhibit high stability therein. In addition, as shown in Table 5 (appearing later in this specification) which lists the hardnesses (Vickers hardness, Hv) of the intermetallic compound particles and Si particles, particles of AlNi $Al_3Ni$, $Al_3Ni_2$, $AlNi_3$ and Si are all harder than 400 Hv. Therefore, by incorporating the powders of any of these hard compounds in the matrix formed of the mother alloy, alloys having excellent wear resistance can be attained.

The dispersed particles are preferably incorporated in the mother alloy in amounts of 3–50 wt %, more preferably 5–20 wt %, and most preferably 10–20 wt %. If the addition of the dispersed particles is less than 3 wt %, they are not effective in improving wear resistance. If, on the other hand, the dispersed particles are incorporated in the mother alloy in amounts exceeding 50 wt %, the mother alloy will solidify too quickly at the stage of agitation so that it is difficult to produce the desired dispersion-hardened alloy by the process of the present invention.

The dispersed particles preferably have a size of no more than 100 μm, with 50 μm and below being a more preferred range. If the size of the dispersed particles exceeds 100 μm, they will not be uniformly dispersed in the matrix and the resulting alloy will have deteriorated mechanical properties. In other words, it is when the particles of Ni, Si or an intermetallic compound selected from among AlNi, $Al_3Ni$, $Al_3Ni_2$ and $AlNi_3$ are uniformly dispersed in the matrix that a desired dispersion-hardened alloy, which exhibits high wear resistance and other desirable mechanical properties without sacrificing ductility, can be produced.

Figure 2:
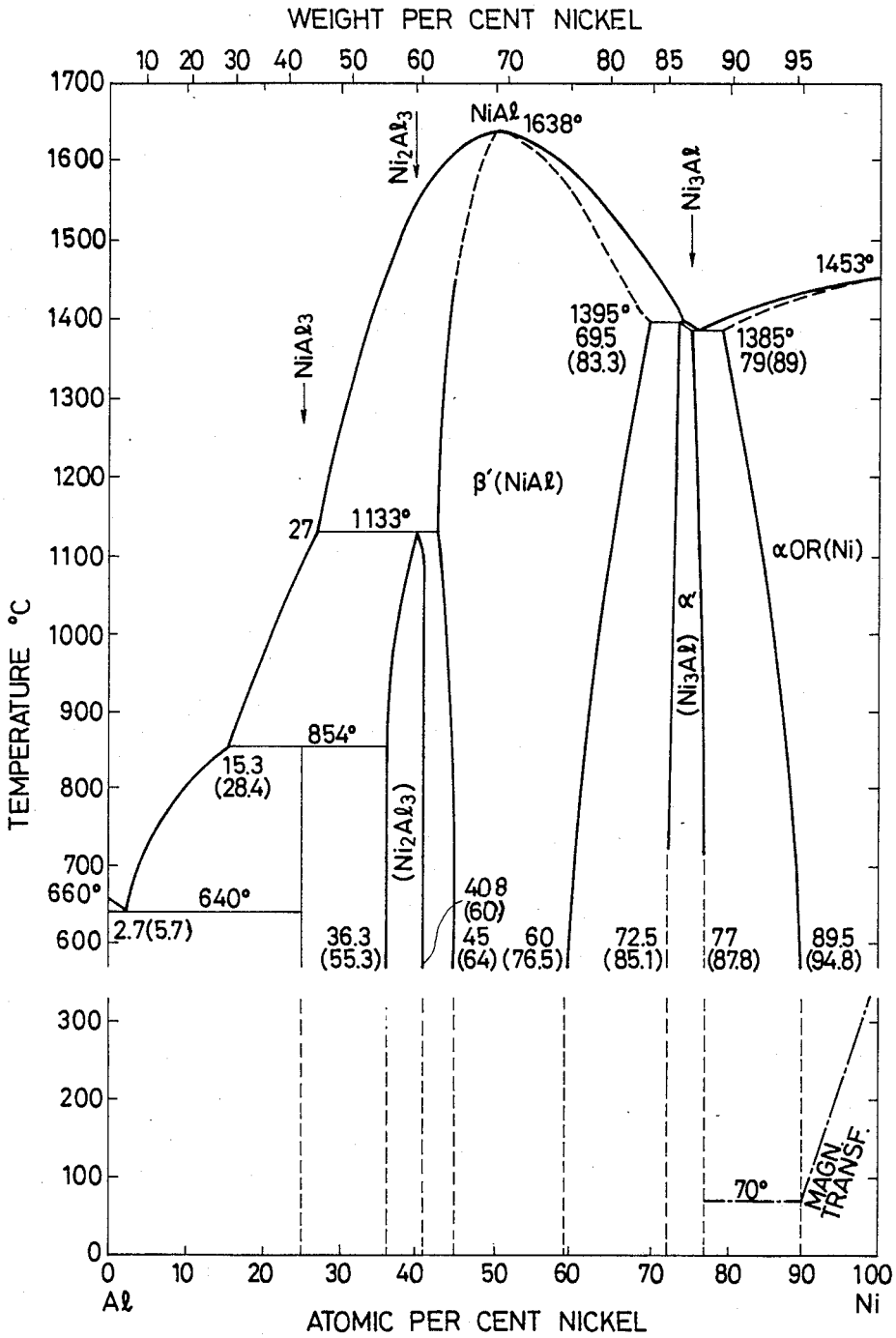
FIG. 2 is an Al-Ni phase diagram.
Figure 3A:
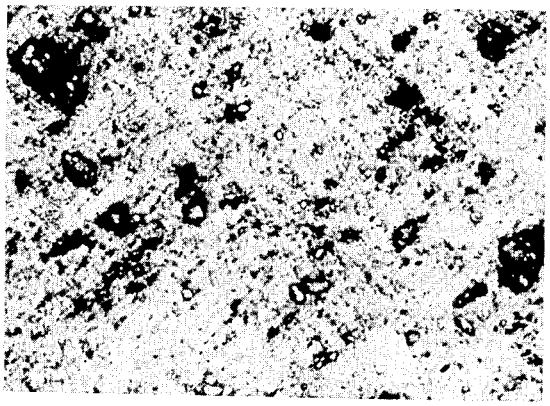
FIGS. 3*a*, 3*b* and 3*c* are micrographs (×50) showing the metallurgical structure of three types of the dispersion-hardened alloy of the present invention that are respectively strengthened by dispersion of the particles of $Al_3Ni_2$, $Al_3Ni$ and $AlNi_3$ intermetallic compounds.
Figure 3B:
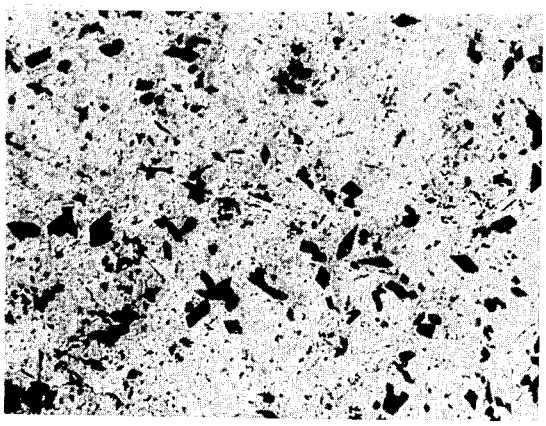
Figure 3C:
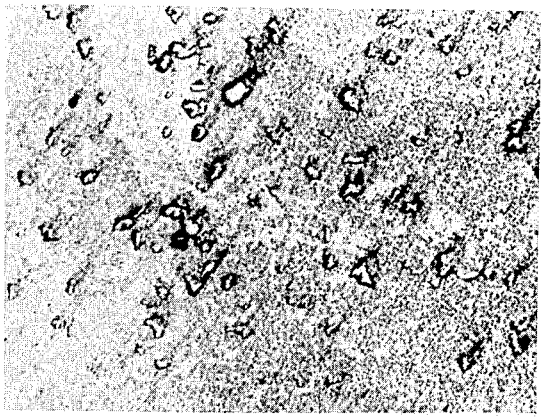

Having described the basic composition of the dispersion-hardened alloy of the present invention which is strengthened by particles of a metal or an intermetallic compound dispersed in the matrix, we will hereunder explain in detail the process for producing this dispersion-hardened alloy with reference to FIGS. 1 and 2. FIG. 1 is a partial cross section showing schematically and example of the mixer/stirrer that can be employed in producing the dispersion-hardened alloy of the present invention.

A predetermined amount of a melt of a matrix forming Al-Ni base alloy or Al-Si-Cu base alloy (mother alloy) is poured into the mixing/stirring vessel 2 of the apparatus; subsequently, a predetermined amount of strengthening particles is added to the melt and agitating blades 3 are rotated with a motor 4 to stir the charge in the vessel 2 for a short period of time until molten alloy 1 having the added particles mixed therein is formed.

As is clear from FIG. 2, a molten Al-Ni base alloy preferably has a temperature of 640°–800° C., more preferably 660°–780° C., and most preferably 670°–730° C. If the heating temperature is less than 640° C., the Al-Ni base alloy will not become molten and beyond 800° C., the dispersed particles will dissolve away too quickly.

A molten Al-Si-Cu base alloy preferably has a temperature of 690°–860° C., and more preferably 700°–830° C., most preferably 730°–810° C. If the heating temperature is less than 690° C., the liquid alloy is solidified instantaneously at the addition of the dispersed particles. If the temperature is beyond 860° C., the dispersed particles will dissolve away too quickly.

The charge in the vessel 2 should be stirred for such a duration of time that the added particles will neither agglomerate nor dissolve away and that they can be uniformly dispersed in the matrix by subsequent shaping with a die-casting machine. The preferred time of stirring should not be more than 5 minutes and the more preferred range is from 5 to 60 seconds, with the range of 7–15 seconds being most preferred. If the stirring time exceeds 5 minutes, the added particles will dissolve away in the matrix to form a structure in which they merge with the mother alloy and fail to offer any improvement in wear resistance.

After being stirred for an appropriate period, the molten alloy 1 having the added particles mixed therein is fed into a die-casting machine and shaped into a desired form. Also, at the stage of die-casting, the added particles will be dispersed in the matrix to form an even more uniform dispersion since the molten alloy is projected in a form of mist and the particles are mixed with the alloy at the projection.

The alloy produced in this way has the added particles dispersed uniformly in the matrix and offers high wear resistance and superior mechanical properties such as ductility. Therefore, in accordance with the present invention, a desired dispersion-hardened alloy of a complex shape can be produced easily and at low cost without employing any of the costly surface treatments or oxidation preventing methods or apparatus that have been required in the conventional techniques of powder metallurgy based on sintering.

The following examples are provided for the purpose of further illustrating the present invention but are in no sense to be taken as limiting.

EXAMPLE 1

Figure 10A:
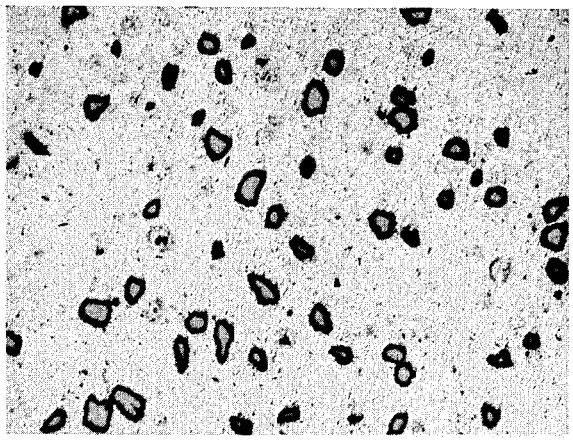
FIGS. 10*a* to 10*d* are micrographs (×50) showing the structures of the test specimens prepared in Example 3.
Figure 10B:
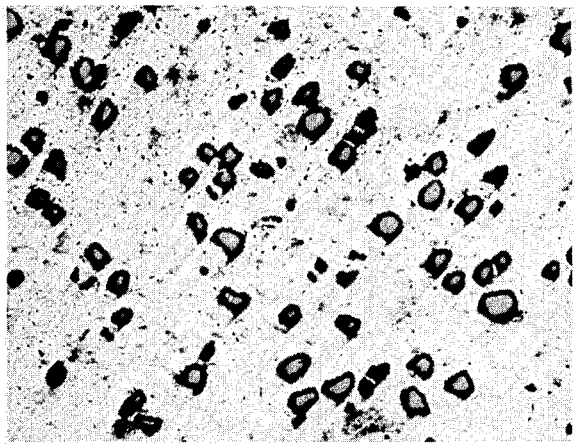
Figure 10C:
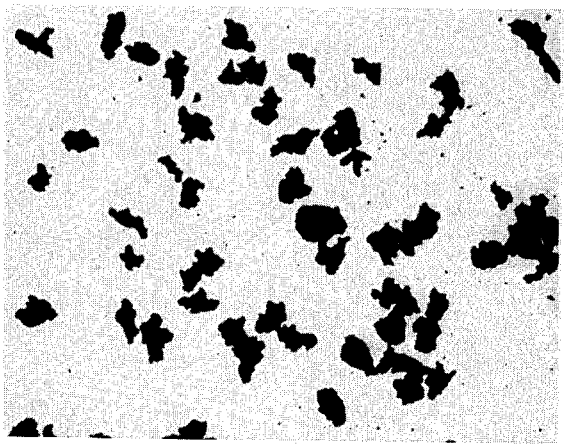
Figure 10D:
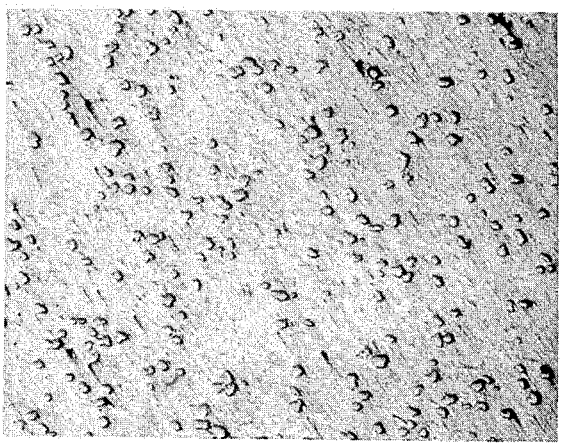

Five samples of a matrix-forming mother alloy were prepared by melting Al-6 wt % Ni-5 wt % Mg. To the respective samples, the powders of four intermetallic compounds (AlNi, $Al_3Ni_2$, $Al_3Ni$ and $AlNi_3$) and nickel were added in an amount of 10 wt %. Each of the added powders had an average particle size of 44 μm. Each of the resulting mixtures was charged into a mixer/stirrer of the type shown in FIG. 1 and stirred for an appropriate period. The resulting intimate mixtures were poured into a mold cavity by means of a die-casting machine so as to prepare test specimens of the dispersion-hardened alloy of the present invention that were strengthened by particles of Ni or Al-Ni base intermetallic compounds dispersed in the matrix. A micrograph (×50) of the powder of AlNi intermetallic compound before addition to the melt of matrix is shown in FIG. 10*c*. Micrographs (×50) of two specimens of the dispersion-hardened alloy that were strengthened by addition of the AlNi intermetallic compound as shown in FIG. 10*c* and which were taken at the mold tip and the pouring gate are shown in FIGS. 10*a* and 10*b*. Micrographs (×50) of the specimens that were dispersion-hardened by the powders of Ni and the $Al_3Ni_2$, $Al_3Ni$ and $AlNi_3$ intermetallic compounds are shown in FIGS. 10*d*, 3*a*, 3*b* and 3*c*, respectively.

As is clear from FIGS. 10*a*, 10*b*, 3*a*, 3*b* and 3*c*, the specimens prepared in accordance with the present invention are characterized by uniform dispersion of the powders of AlNi, $Al_3Ni_2$, $Al_3Ni$, $AlNi_3$, intermetallic compounds and Ni in the mother alloy.

Comparison between FIG. 10*c* and each of FIGS. 10*a* and 10*b* will make it clearly evident that the AlNi intermetallic compound was dispersed uniformly and remained intact, though it slightly dissolved away in the mother alloy.

It was therefore clear that the particles of Ni and the four intermetallic compounds, AlNi, $Al_3Ni_2$, $Al_3Ni$ and $AlNi_3$, which had very high levels of hardness (see Table 5), exhibited a very high level of binding or wetting with the Al-Ni base alloy matrix, and that these particles remained highly stable in the matrix. Therefore, these particles can be readily mixed with the melt of the mother alloy and can be uniformly dispersed therein.

Because of these features, the dispersion-hardened alloys of the present invention offer superior wear resistance without losing the inherently good mechanical properties of the Al-Ni base mother alloy.

EXAMPLE 2

Ni powder or an AlNi intermelallic compound was added to molten mother alloys and the agitated mixtures were die-cast to prepare specimens of dispersion-hardened alloys for tensile testing and wear testing.

The mother alloys employed were Al-6 wt % Ni-5 wt % Mg and Al-6 wt % Ni. To each of these mother alloys, Ni powder or the powder of an AlNi intermetallic compound was added in varying amounts of 3, 5, 7, 10, 20, 30, 40 and 50 wt %.

Comparative test specimens were prepared by die-casting the following alloys: Al-6 wt % Ni-5 wt % Mg, Al-6 wt % Ni, Al-6 wt % Ni-5 wt % Mg dispersion-hardened by addition of 2 wt % Ni or AlNi intermetallic compound powder, Al-6 wt % Ni dispersion-hardened by addition of 2 wt % Ni or AlNi intermetallic compound powder, aluminum-silicon alloy 390, and 5 wt % $Si_3n_4$/ADC10.

The Al base mother alloys employed in preparing the samples of the present invention and the comparative samples had the chemical compositions specified in Table 4.

These samples were subjected to tensile testing and wear testing. The wear test was conducted with an Ohgoshi testing machine, with a standard rotary disk of FC 25 being used as the member by which the samples were abraded. The other wear testing conditions were as follows: lubrication, absent; final load, 2.1 Kg; sliding distance, 100 m; sliding speed, variable at 0.94, 1.96, 2.86 and 4.36 m/sec. The amount of specific wear caused on the samples was determined by measuring the width of wear marks.

The results of the wear test are summarized in Tables 1, 2 and 2*a*, as well as in FIGS. 4 to 9.

Figure 4:
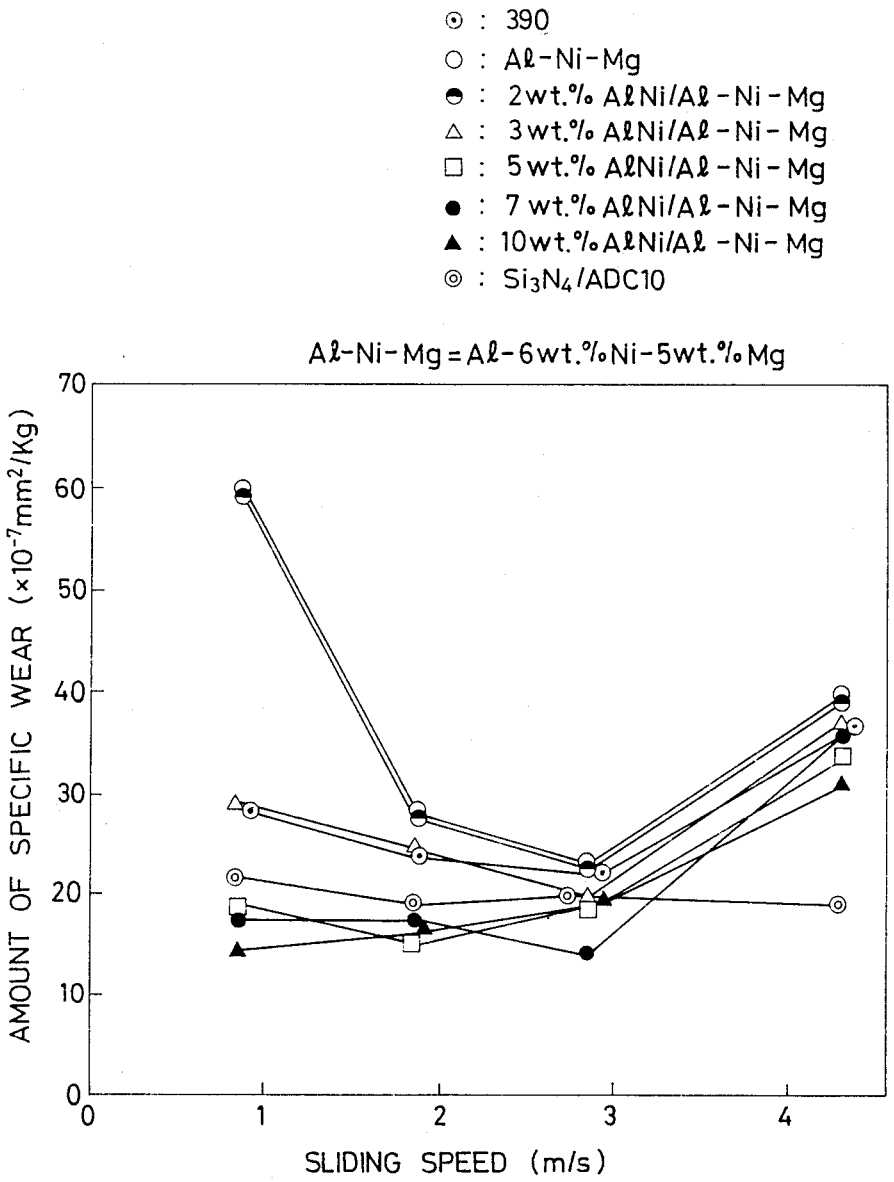
FIGS. 4 to 9 are each a graph showing the amount of specific wear of test specimens as a function of the rate of sliding on an FC 25 disk.
Figure 5:
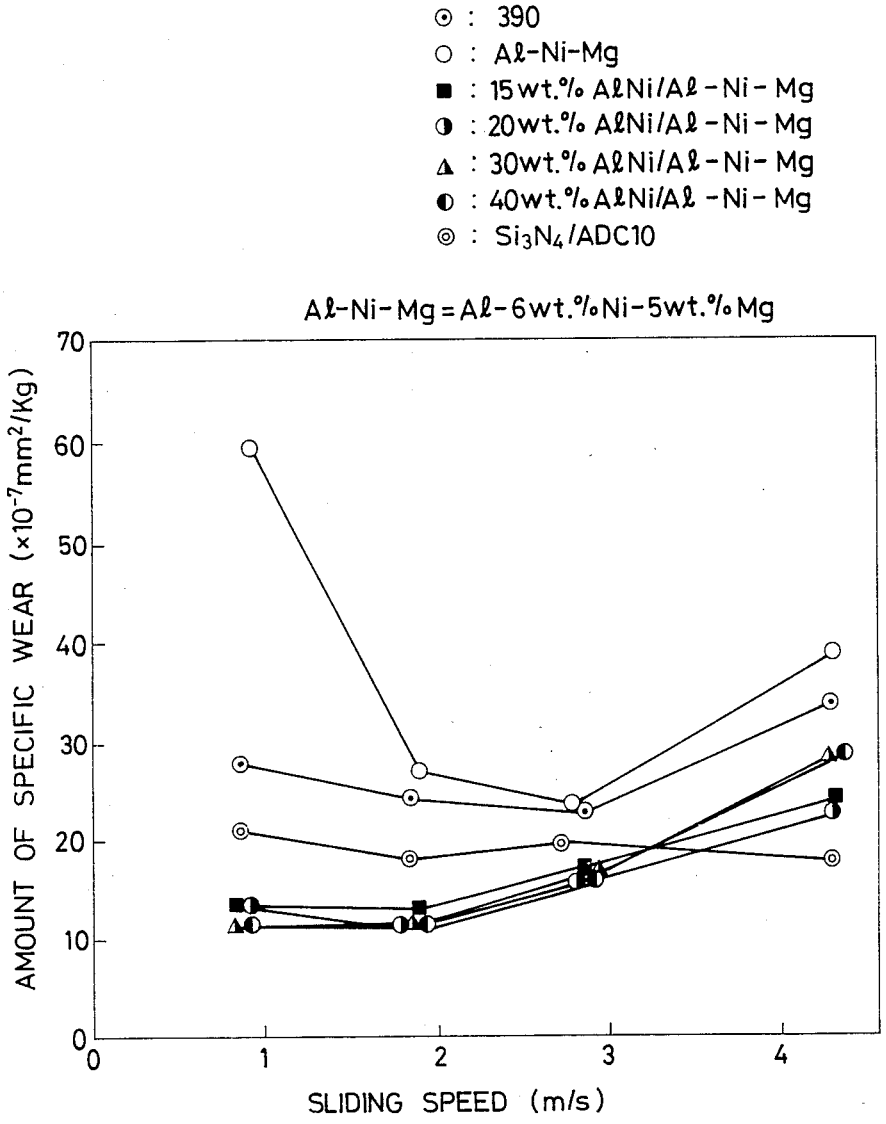

FIGS. 4 and 5 are graphs plotting the amounts of specific wear (vertical axis) of the comparative samples (see Table 1) and the samples of AlNi-dispersion hardened alloys of the present invention (also see Table 1; matrix, Al-6 wt % Ni-5 wt % Mg) as a function of sliding speed (horizontal axis). FIG. 4 shows the case where the samples of the present invention were strengthened by dispersion of AlNi particles present in amounts of 3, 5, 7 and 10 wt %, and FIG. 5 shows the case where these samples were hardened by dispersion of AlNi particles present in amounts of 15, 20, 30 and 40 wt %. The data for the addition of 50 wt % AlNi is omitted from FIG. 5 since it was the same as the results of the case where AlNi was added in the amount of 40 wt %.

As one can see from Table 1 and FIG. 4, the samples of the present invention strengthened by dispersion of AlNi particles in amounts of 5, 7 and 10 wt % displayed substantially equal levels of wear resistance, which were higher than the level attained by a comparative example that was solely composed of Al-6 wt % Ni-5 wt % Mg. The sample hardened by addition of 3 wt % AlNi was also more wear-resistant than said comparative sample and the amounts of specific wear occurring in this sample at sliding speeds of 2.86 and 4.36 m/sec were substantially the same as those exhibited by the other samples of the present invention containing 5, 7 and 10 wt % AlNi.

When AlNi was incorporated in an amount of less than 3 wt %, such as 2 wt %, in the mother alloy Al-6 wt % Ni-5 wt % Mg, the resulting dispersion-hardened alloy developed wear the specific amount of which was substantially the same as that exhibited by the mother alloy itself, and this shows the absence of any improvement that could be attained by incorporating the AlNi particles.

As one can see from Table 1 and FIG. 5, the samples of the present invention strengthened by dispersion of AlNi particles in amounts of 15, 20, 30, 40 and 50 wt % showed substantially equal amounts of specific wear, and all of them were more wear-resistant than the sample solely composed of the mother alloy Al-6 wt % Ni-5 wt % Mg.

The sample that was dispersion-hardened by inclusion of 50 wt % AlNi was as wear-resistant as the sample containing 40 wt % AlNi. However, if AlNi particles were incorporated in amounts exceeding 50 wt %, the mother alloy would start to solidify too rapidly at the stage of stirring to enable the production of a desired dispersion-hardened alloy by the process of the present invention.

Figure 6:
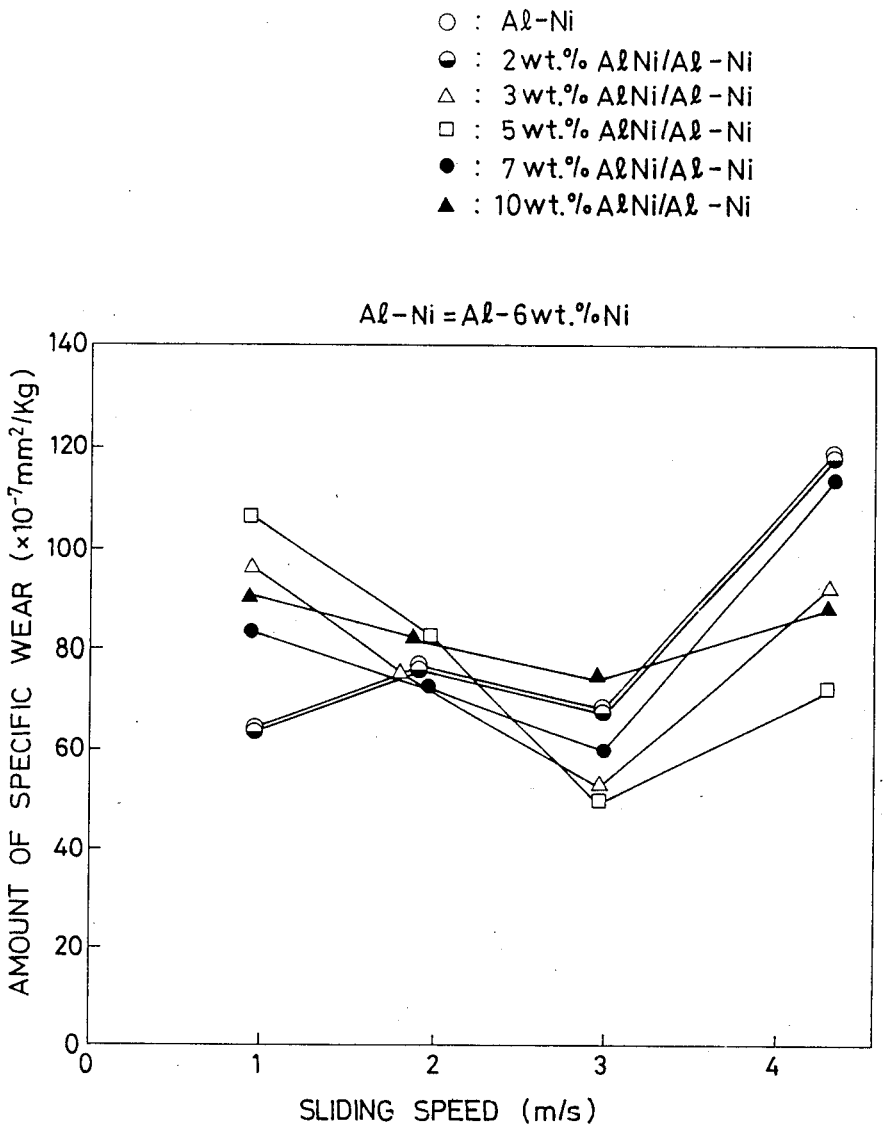
Figure 7:
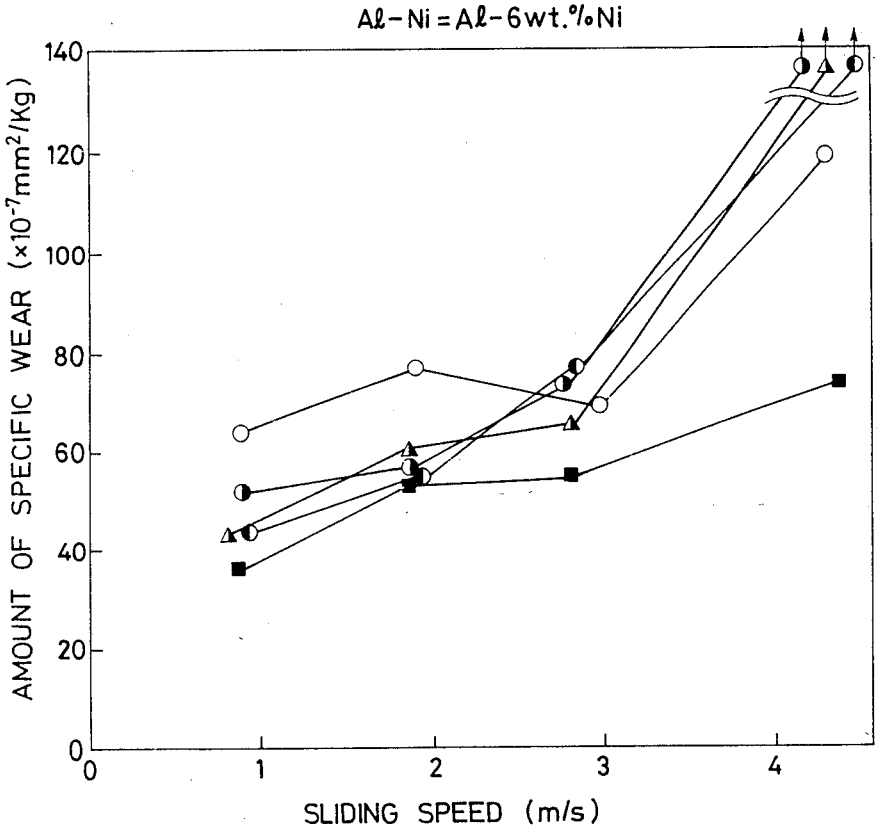

FIGS. 6 and 7 are graphs plotting the amounts of specific wear (vertical axis) of the comparative samples (see Table 2) and the samples of AlNi-dispersion hardened alloys of the present invention (also see Table 2; matrix, Al-6 wt % Ni) as a function of sliding speed (horizontal axis). FIG. 6 shows the case where the samples of the present invention were strengthened by dispersion of AlNi particles present in amounts of 3, 5, 7 and 10 wt %, and FIG. 7 shows the case where these samples were hardened by dispersion of AlNi particles present in amounts of 15, 20, 30, 40 and 50 wt %. The data for the addition of 50 wt % AlNi is omitted from FIG. 7 since it was the same as the results of the case where AlNi was added in the amount of 40 wt %.

As one can see from Table 2 and FIG. 6, the samples of the present invention that were strengthened by dispersing AlNi particles in amounts of 3, 5, 7 and 10 wt % proved to be more wear-resistant at a sliding speed of 4.36 m/sec than the comparative samples, one being solely made of the mother alloy (Al-6 wt % Ni) and the other being composed of 2 wt % AlNi/Al-6 wt % Ni.

As one can also see from Table 2 and FIG. 7, the samples of the present invention that were strengthened by dispersing AlNi particles in amounts of 15, 20, 30 and 40 wt % proved to be more wear-resistant than the Al-6 wt % Ni alloy at sliding speeds of 0.94 and 1.96 m/sec.

Figure 8:
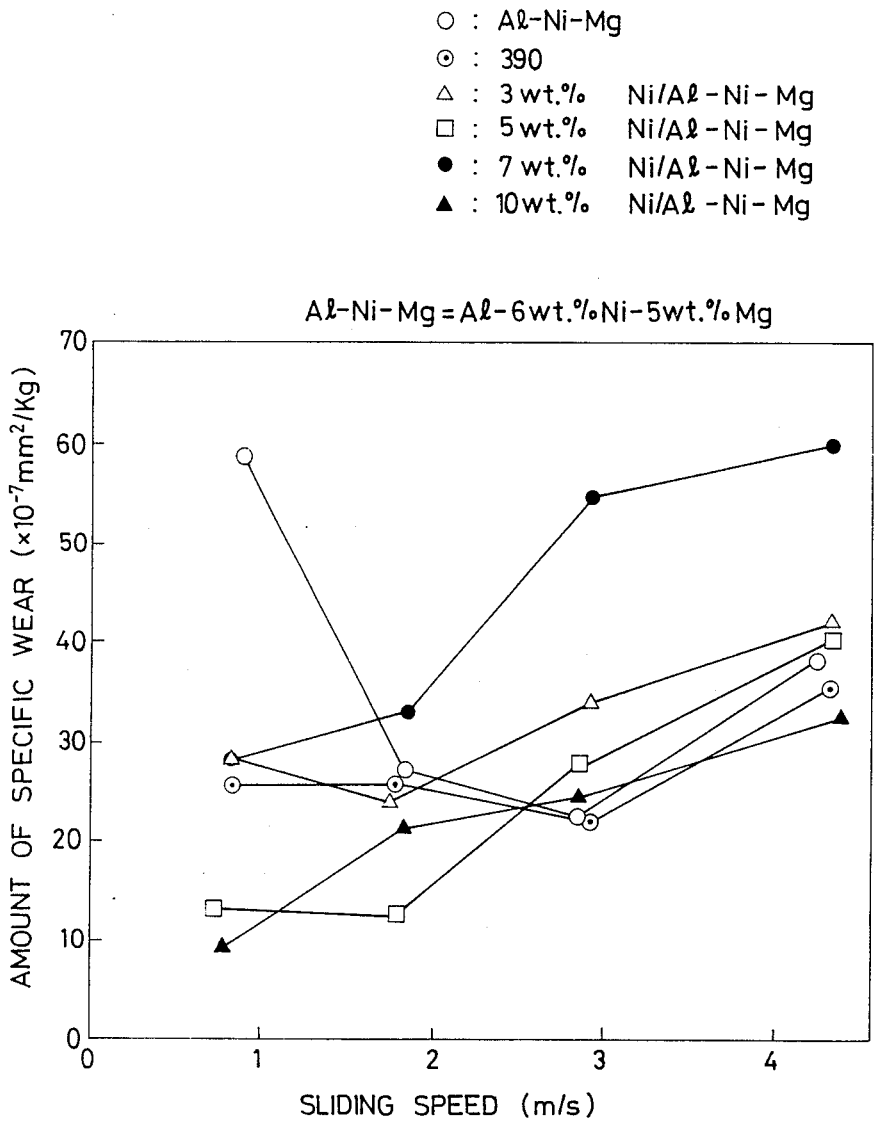
Figure 9:
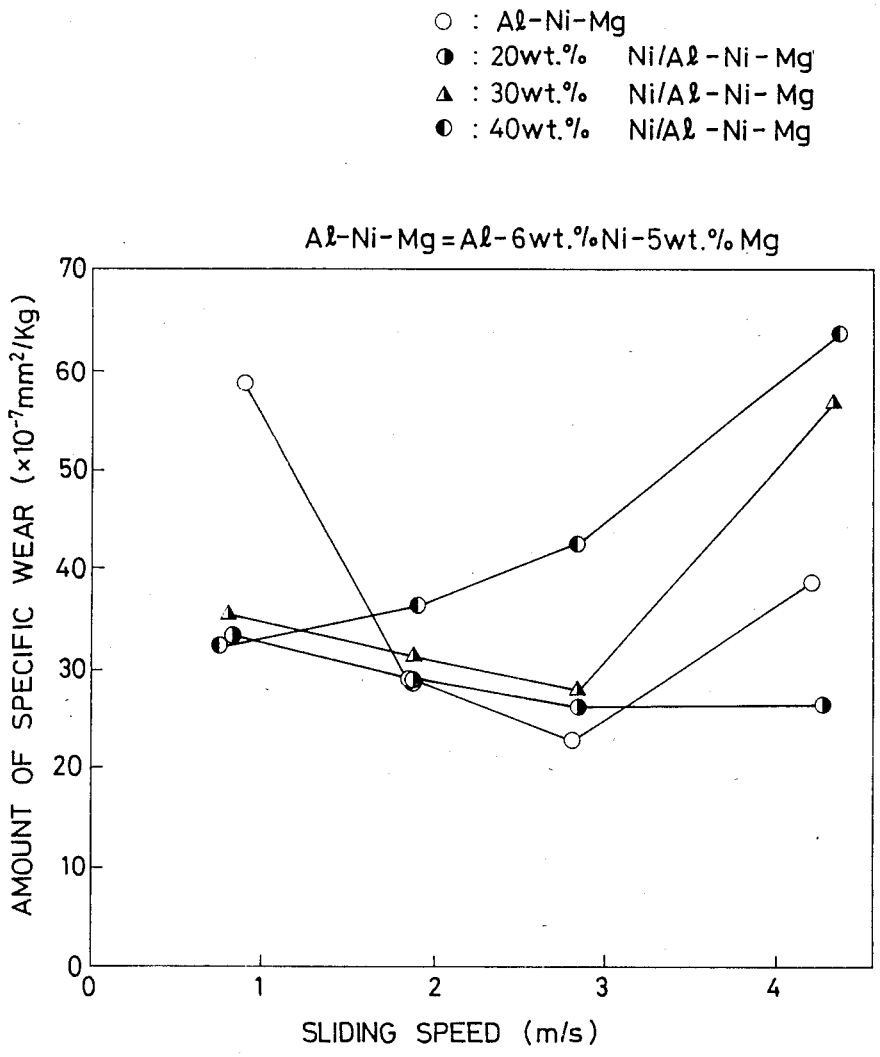

FIGS. 8 and 9 are graphs plotting the amounts of specific wear (vertical axis) of the comparative samples (see Table 2*a* ) and the samples of Ni-dispersion hardened alloys of the present invention (also see Table 2*a*; matrix, Al-6 wt % Ni-5 wt % Mg) as a function of sliding speed (horizontal axis). FIG. 8 shows the case where the samples of the present invention were strengthened by dispersion of Ni particles present in amounts of 3, 5, 7 and 10 wt %, and FIG. 9 shows the case where these samples were hardened by dispersion of Ni particles present in amounts of 20, 30 and 40 wt %. The data for the addition of 50 wt % Ni is omitted from FIG. 9 since it was the same as the results of the case where Ni was added in the amount of 40 wt %.

As one can see from Table 2*a* and FIG. 8, the samples of the present invention that were strengthened by dispersing Ni particles in amounts of 3, 5, 7 and 10 wt % proved to be more wear-resistant at sliding speeds of 0.94 and 1.96 m/sec than the comparative samples, one being solely made of the mother alloy (Al-6 wt % Ni-5 wt % Mg) and the other being composed of aluminum-silicon alloy 390.

As one can also see from Table 2*a* and FIG. 9, the samples of the present invention that were strengthened by dispersing Ni particles in amounts of 20,30 and 40 wt % proved to be more wear-resistant than the Al-6 wt % Ni-5 wt % Mg alloy at a sliding speed of 0.94 m/sec.

The mechanical properties of three selected samples of the present invention that were strengthened by dispersion of Ni or AlNi particles were compared with those of three selected comparative samples, and the results are shown in Table 3. As one can see from this table, the samples of the present invention had a very high level of ductility since they exhibited elongations as high as 3.6–8.4% as compared with elongation of 0.7% that was exhibited by two samples of ADC 10 that were strengthened by the addition of 5 wt % $Si_3N_4$ and 10 wt % SiC, respectively.

EXAMPLE 3

Particles of $Al_3Ni$, AlNi or $AlNi_3$ having an average size of no more than 44 μm were directly added to the melt of Al-(3.5–8.0)wt % Ni alloy at a temperature between 640° and 700° C. The resulting mixture was charged into a mixer/stirrer of the type shown in FIG. 1 and subsequently poured into a mold cavity by means of a die-casting machine. The structures of two specimens that were sampled at the mold tip and the pouring gate respectively, are show micrographically (×50) in FIGS. 10*a* and 10*b*. The structure of the AlNi particles before addition to the molten mother alloy is shown micrographically (×50) in FIG. 10*c*. The structure of a specimen that was prepared as above except that 10 wt % Ni particles were added to the melt of Al-7 wt % Ni-5 wt % Mg is shown micrographically (×50) in FIG. 10*d*.

As is clear from FIGS. 10*a* to 10*d*, the specimens prepared in accordance with the present invention are characterized by uniform dispersion of the AlNi or Ni particles in the mother alloy.

Both of the Ni and intermetallic AlNi particles exhibit a very high level of binding or wetting with the Al-Ni base alloy matrix, and they will remain highly stable in the matrix. Therefore, these particles can be readily mixed with the melt of the mother alloy and can be uniformly dispersed therein.

A Ni powder or a powder of an AlNi intermetallic compound was added to molten Al-Ni base mother alloys and the mixture obtained by agitation were die-cast to prepare test specimens of dispersion-hardened alloys, which were subjected to both tensile testing and wear testing.

The wear test was conducted with an Ohgoshi testing machine under non-lubricating conditions. The other testing conditions were as follows: final load, 2.1 Kg, sliding distance 200 m; sliding speed, variable at 0.94, 1.96, 2.86 and 4.36 m/sec. The amount of specific wear caused on the samples was determined by measuring the width of wear marks.

Figure 11:
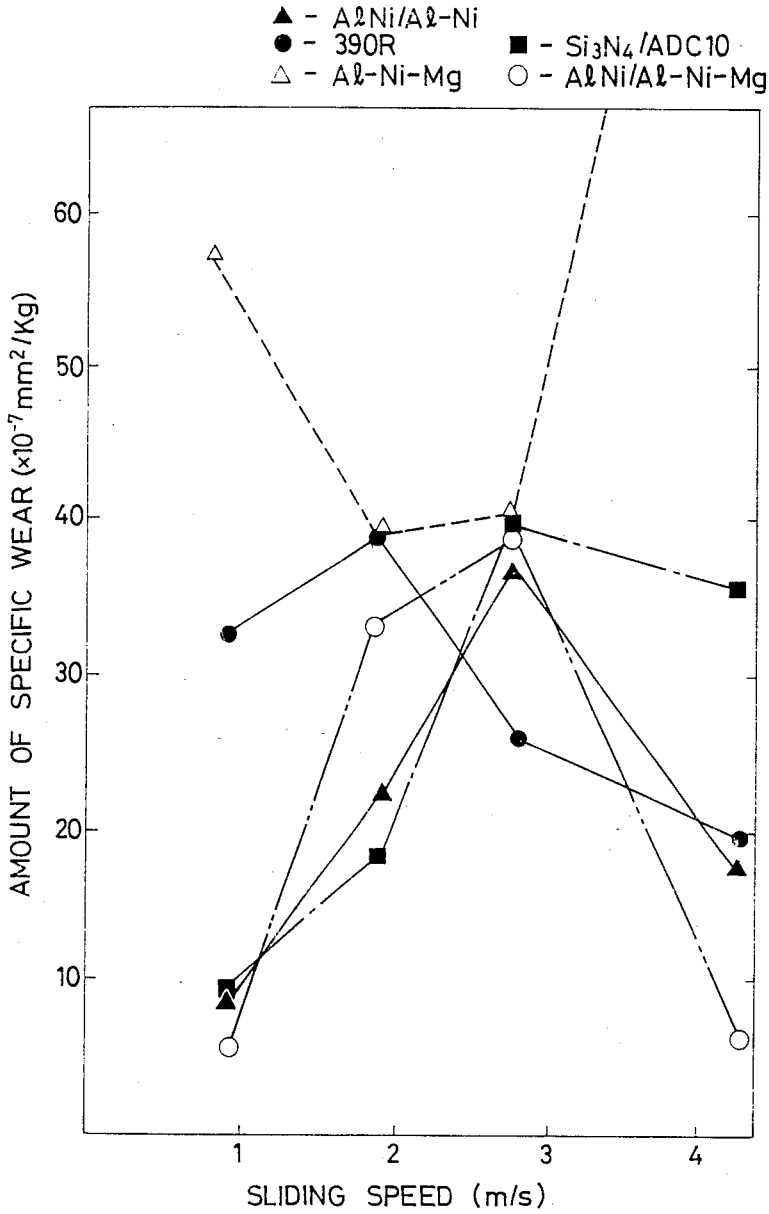
FIGS. 11 and 12 are graphs showing the amount of specific wear of these test specimens as a function of the rate of sliding on an FC 25 or SUJ 2 disk.
Figure 12:
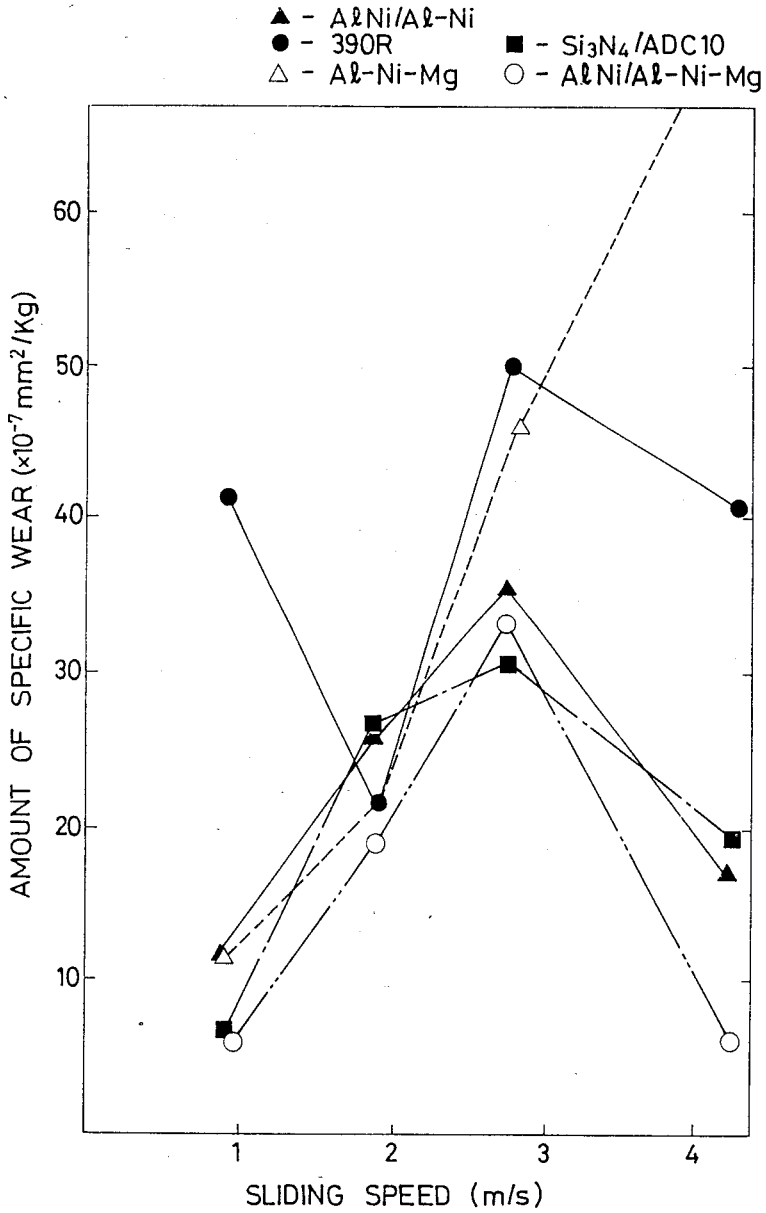
Figure 13A:
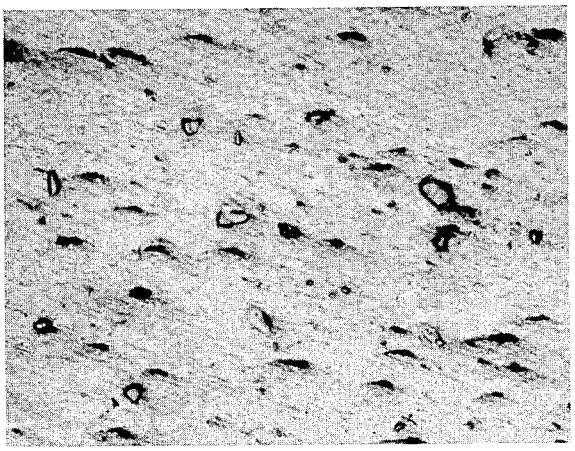
FIGS. 13*a*, 13*b*, 13*c* and 13*d* are micrographs showing the metallurgical structure of test specimens that were prepared by first-adding $Al_3Ni$, AlNi, $AlNi_3$ or Si particles to a molten mother alloy, (Al-8 wt % Si-3 wt % Cu), then agitating the melt, and finally pouring the resulting mixtures by means of a die-casting machine.
Figure 13B:
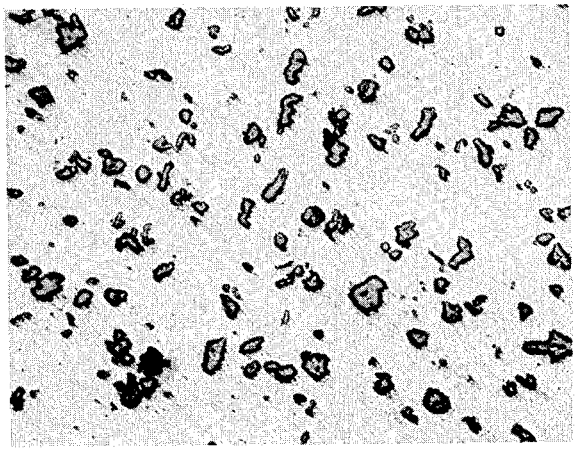
Figure 13C:
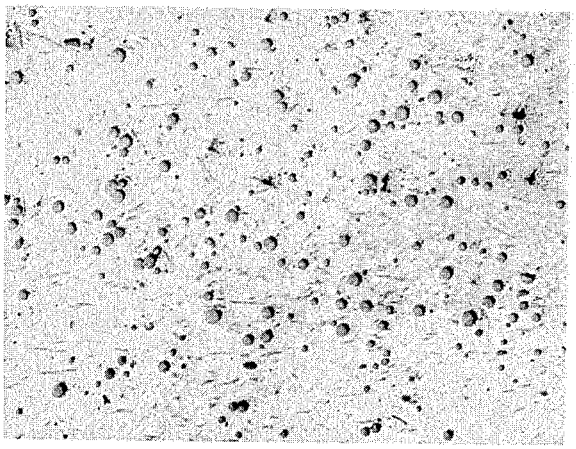
Figure 13D:
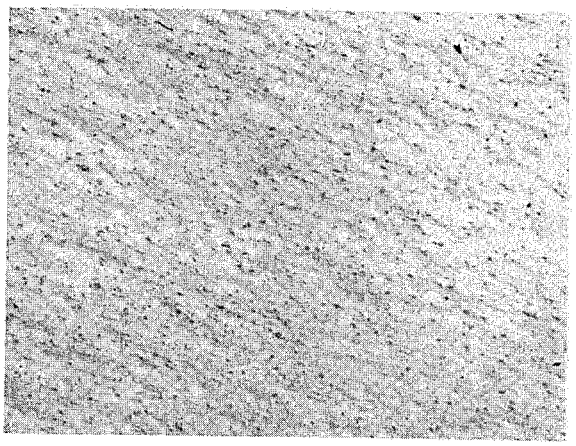
Figure 14A:
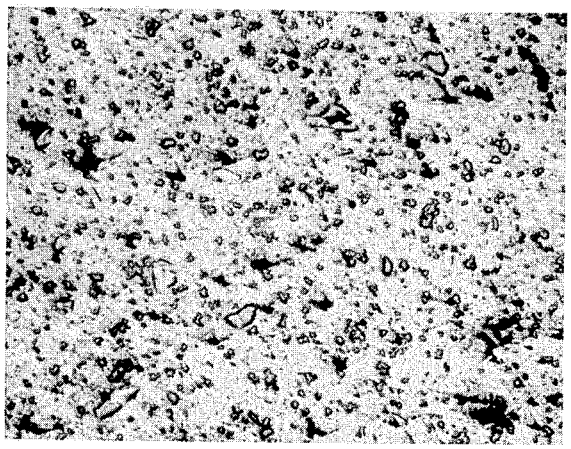
FIGS. 14*a*, 14*b*, 14*c* and 14*d* are micrographs showing the metallurgical structure of test specimens that were prepared by the same procedures as described above except that Al-19 wt % Si-7 wt % Cu was used as the matrix-forming mother alloy.
Figure 14B:
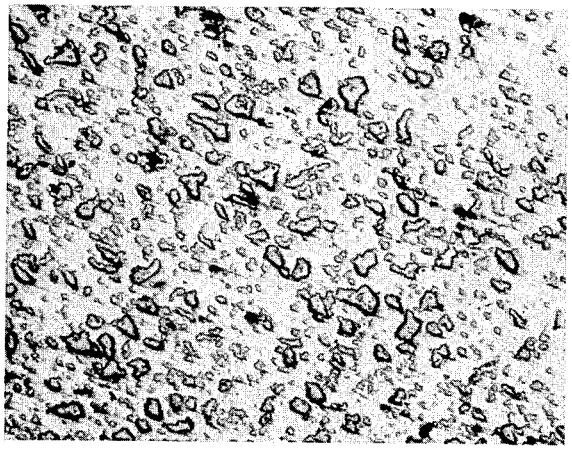
Figure 14C:
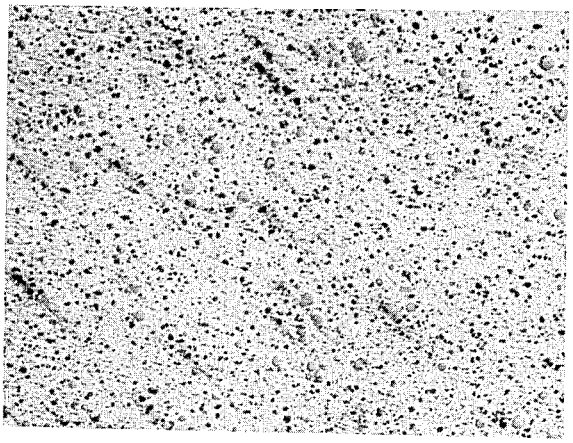
Figure 14D:
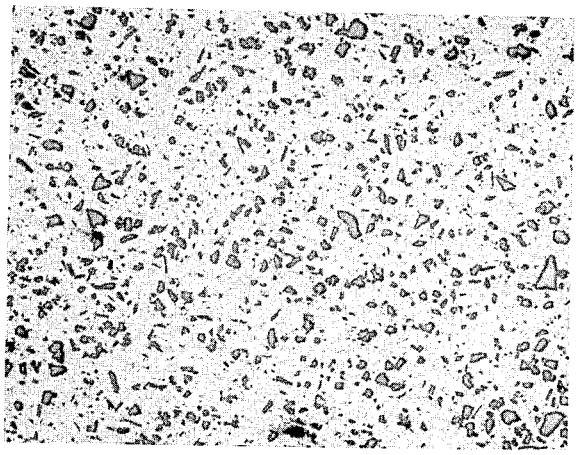

The results of the wear test are summarized in Tables 6 and 7, as well as in FIGS. 11 and 12.

Table 6 shows the data for sliding speed, sliding distance, final load, wear mark width and the amount of specific wear caused by abrading with an FC 25 disk five different types of samples, i.e., aluminum-silicon alloy 390, Al-Ni-Mg alloy, ADC 10 strengthened by dispersion of $Si_3N_4$ particles, and two dispersion-hardened alloys that were strengthened by AlNi particles in accordance with the present invention. FIG. 11 is a graph plotting the amounts of specific wear (vertical axis) as a function of the sliding speed (horizontal axis).

As is clear from FIG. 11, the dispersion-hardened alloys of the present invention which were strengthened by dispersion of AlNi particles were at least twice as wear-resistant as the $Si_3N_4$ dispersion-hardened alloy at a high sliding speed of 4.36 m/sec.

Table 7 shows the results of wear tests conducted by abrading with an SUJ2 disk, five different types of samples, i.e., aluminum-silicon 390, Al-Ni-Mg alloy, ADC 10 strengthened by dispersion of $Si_3N_4$ particles, and two dispersion-hardened alloys that were strengthened with AlNi particles in accordance with the present invention. FIG. 12 is a graph plotting the amounts of specific wear as a function of the sliding speed.

As is clear from FIG. 12, the dispersion-hardened Al-Ni-Mg alloy of the present invention which was strengthened by dispersion of AlNi particles was approximately twice as wear-resistant as the $Si_3N_4$ dispersion-hardened alloy both at a high sliding speed of 4.36 m/sec and at a low sliding speed of 1.96 m/sec.

EXAMPLE 4

Four samples of a matrix-forming mother alloy were prepared by melting Al-Si-Cu alloys. To the respective samples, the powders of three intermetallic compounds (AlNi, $Al_3Ni$ and $AlNi_3$) and silicon were added. Each of the added powders had an average particle size of 44 μm or less. Each of the resulting mixtures was charged into a mixer/stirrer of the type shown in FIG. 1 and stirred for an appropriate period. The resulting intimate mixtures were poured into a mold cavity by means of a die-casting machine so as to prepare test specimens of the dispersion-hardened alloy of the present invention that were strengthened by particles of Si or Al-Ni base intermetallic compounds dispersed in the matrix.

Micrographs (×50) of these specimens are shown in FIGS. 13*a*, 13*b*, 13*c* and 13*d* (matrix: Al-8 wt % Si-3 wt % Cu) and in FIGS. 14*a*, 14*b*, 14*c* and 14*d* (matrix: Al-19 wt % Si-7 wt % Cu). As is clear from these figures, the specimens prepared in accordance with the present invention are characterized by uniform dispersion of the powders of AlNi, $Al_3Ni$, $AlNi_3$ and Si in the mother alloy.

It is therefore clear that the particles of Si and the three intermetallic compounds, AlNi, $Al_3Ni$ and $AlNi_3$, which have very high levels of hardness (see Table 5), exhibit a very high level of binding or wetting with the Al-Si-Cu base alloy matrix, and that these particles remain highly stable in the matrix. Therefore, these particles can be readily mixed with the melt of the mother alloy and can be uniformly dispersed therein.

Because of these features, the dispersion-hardened alloys of the present invention offer superior wear resistance without losing the inherently good mechanical properties of the Al-Si-Cu base mother alloy.

EXAMPLE 5

Si powder or a powder of the same intermetallic compounds as employed in Example 4 were added to molten mother alloys (for their chemical compositions, see Table 4) and the agitated mixtures were die-cast to prepare specimen of dispersion-hardened alloys for tensile testing and wear testing.

The mother alloys employed were Al-8 wt % Si-3 wt % Cu, Al-15 wt % Si-4 wt % Cu and Al-19 wt % Si-7 wt % Cu. To each of these mother alloys, Si powder or the powder of $Al_3Ni$, AlNi or $AlNi_3$ was added in varying amounts of 5, 10, 20 and 40 wt %.

Comparative test specimens were prepared by die-casting only the mother alloys (i.e., Al-8 wt % Si-3 wt % Cu, Al-15 wt % Si-4 wt % Cu, and Al-19 wt % Si-7 wt % Cu).

The Al-Si-Cu base alloys employed in preparing the samples of the present invention and the comparative samples had the chemical compositions specified in Table 8. These samples were subjected to tensile testing and wear testing. The wear test was conducted with an Ohgoshi testing machine, with a standard rotary disk of FC 25 being used as the member by which the samples were abraded. The other wear testing conditions were as follows: lubrication, absent; final load, 2.1 Kg, sliding distance, 100 m; sliding speed, variable at 0.94, 1.96, 2.86 and 4.36 m/sec. The amount of specific wear caused on the samples was determined by measuring the width of wear marks.

Figure 15:
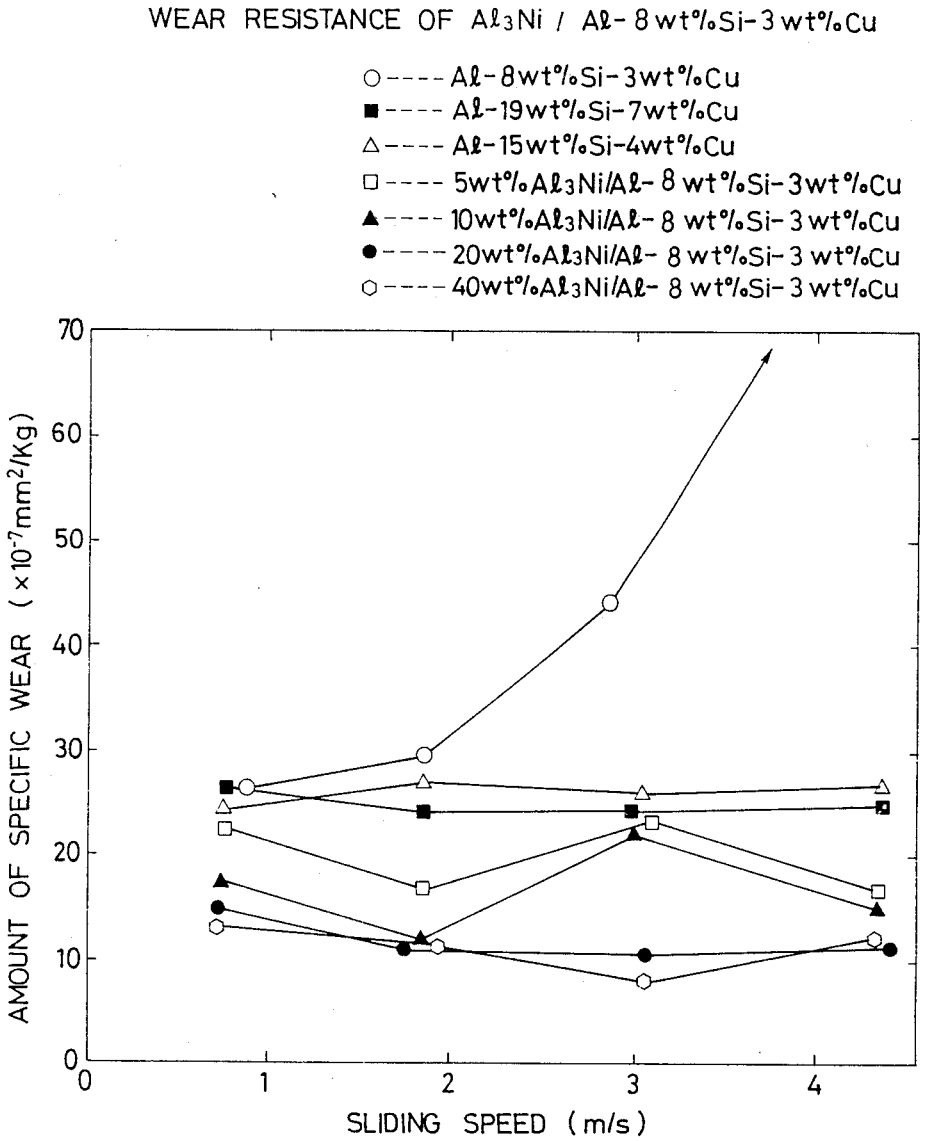
FIGS. 15 to 26 are graphs plotting the amounts of specific wear of the test specimens prepared in Examples 5 and 6 as a function of the rate of sliding on a FC 25 disk.
Figure 16:
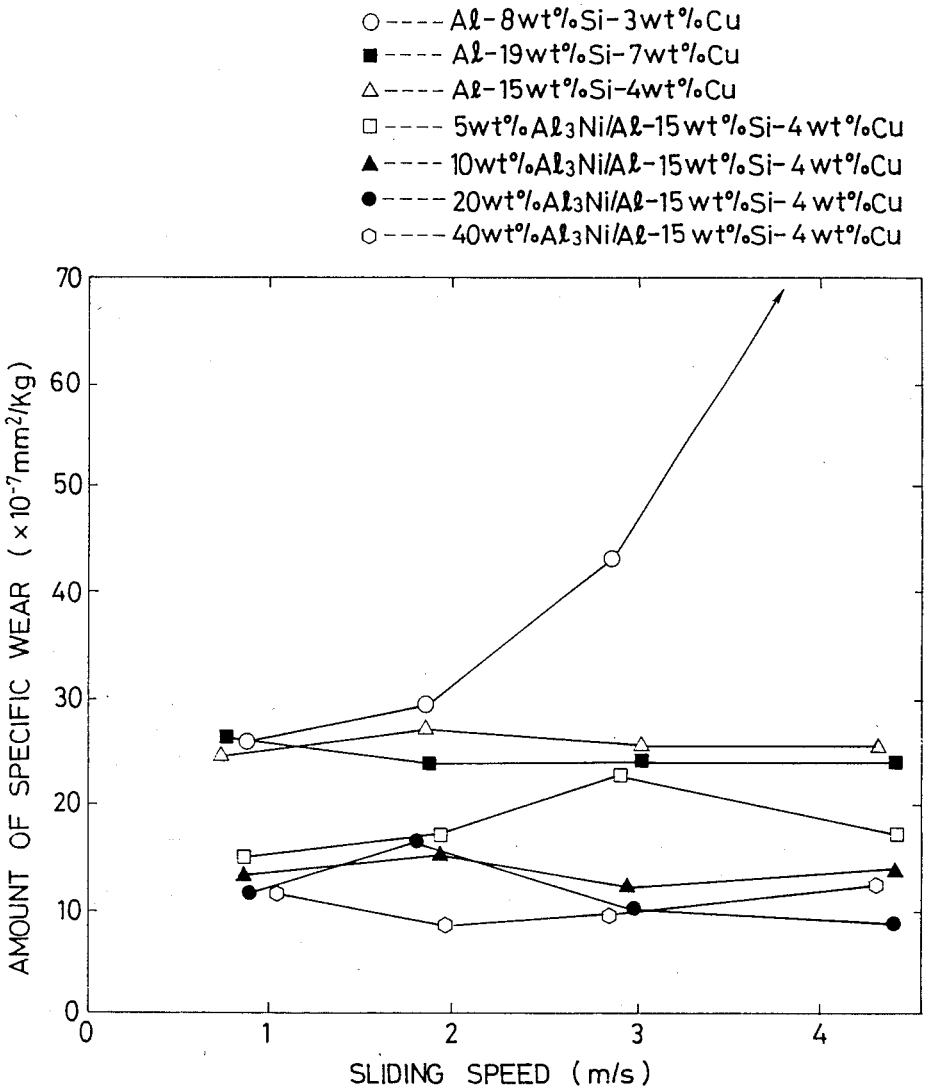
Figure 17:
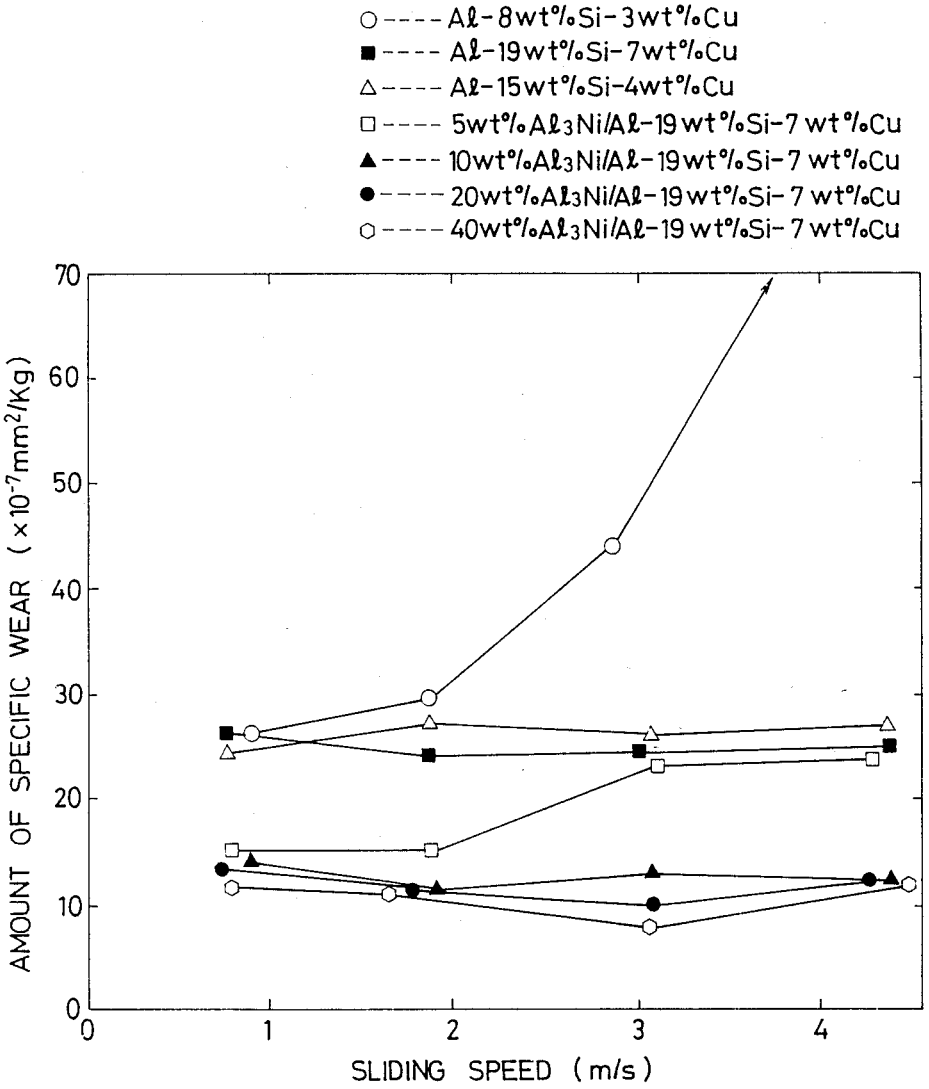

The results of the wear test are summarized in FIGS. 15 to 26. FIGS. 15, 16 and 17 are graphs plotting the amounts of specific wear (vertical axis) of the comparative samples and the samples of $Al_3Ni$-dispersion hardened alloy of the present invention as a function of sliding speed (horizontal axis). All samples used an Al-8 wt % Si-3 wt % Cu (FIG. 15), Al-15 wt % Si-4 wt % Cu (FIG. 16) or Al-19 wt % Si-7 wt % Cu (FIG. 17) alloy as a matrix-forming mother alloy. The samples of the present invention were strengthened by dispersion of $Al_3Ni$ particles present in amounts of 5, 10, 20 and 40 wt %. The wear test was also conducted for the case where $Al_3Ni$ particles were added in amounts of 4 and 50 wt % but the results are not shown in FIGS. 15, 16 and 17 since the the data for the addition of 50 wt % $Al_3Ni$ was the same as results of the case where $Al_3Ni$ was added in an amount of 40 wt % whereas the data for the addition of 4 wt % $Al_3Ni$ was the same as the results of the case where 5 wt% $Al_3Ni$ was added.

As one can see from FIGS. 15, 16 and 17, the samples of the present invention strengthened by dispersion of $Al_3Ni$ particles in amounts of 5, 10, 20 and 40 wt% were more wear-resistant than the comparative samples which were solely made of the mother alloy, i.e., Al-8 wt% Si-3 wt% Cu, Al-15 wt% Si-4 wt% Cu, or Al-19 wt% Si-7 wt% Cu.

When $Al_3Ni$ was incorporated in an amount of less than 4 wt%, such as 3 wt%, in the mother alloys, the resulting dispersion-hardened alloys developed wear the specific amount of which was substantially the same as that exhibited by the mother alloys themselves, and this shows the absence of any improvement that could be attained by incorporating the $Al_3Ni$ particles.

Figure 18:
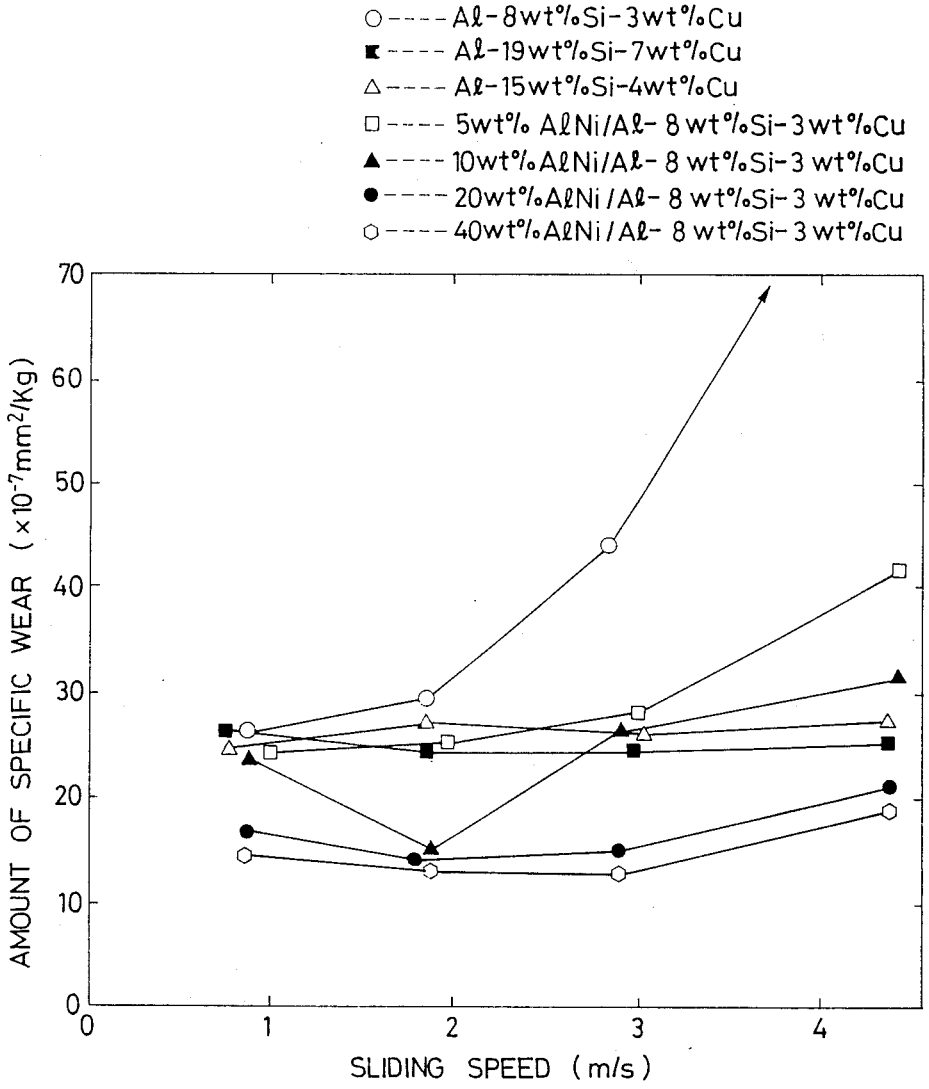
Figure 19:
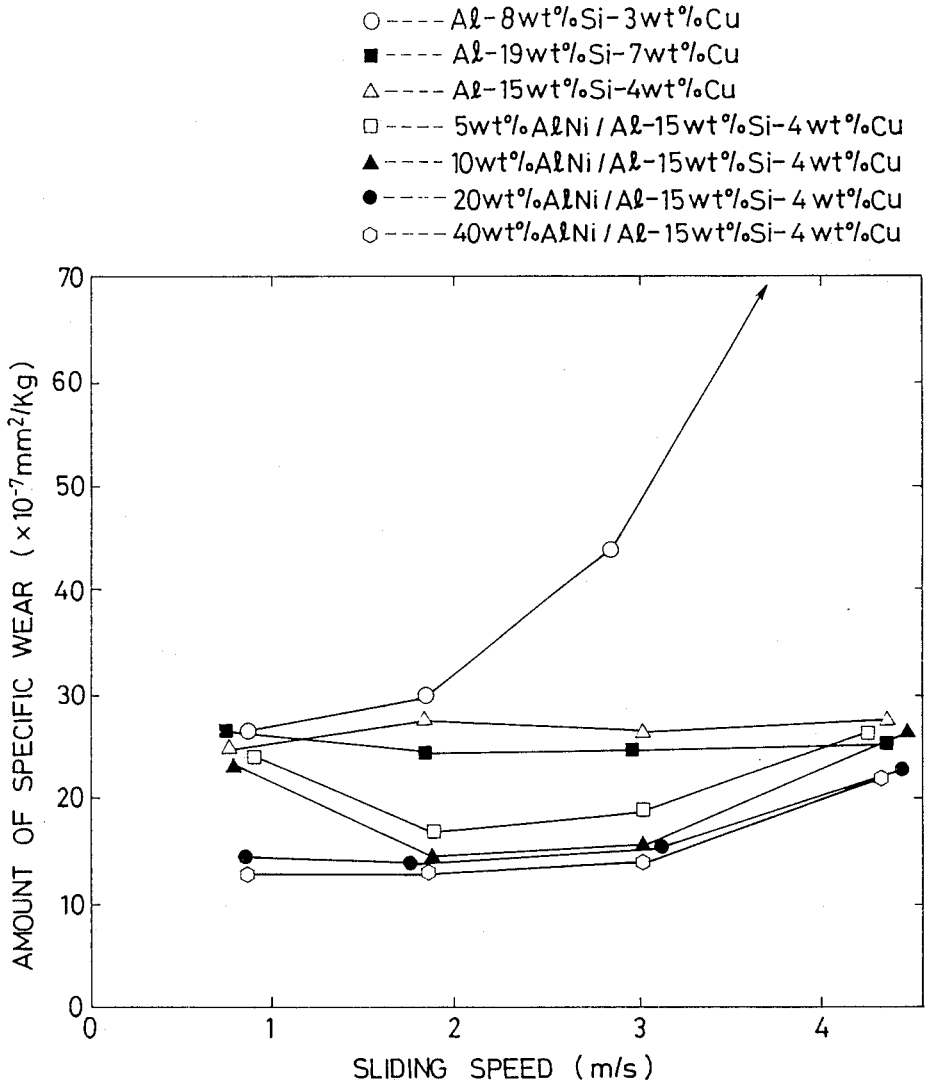
Figure 20:
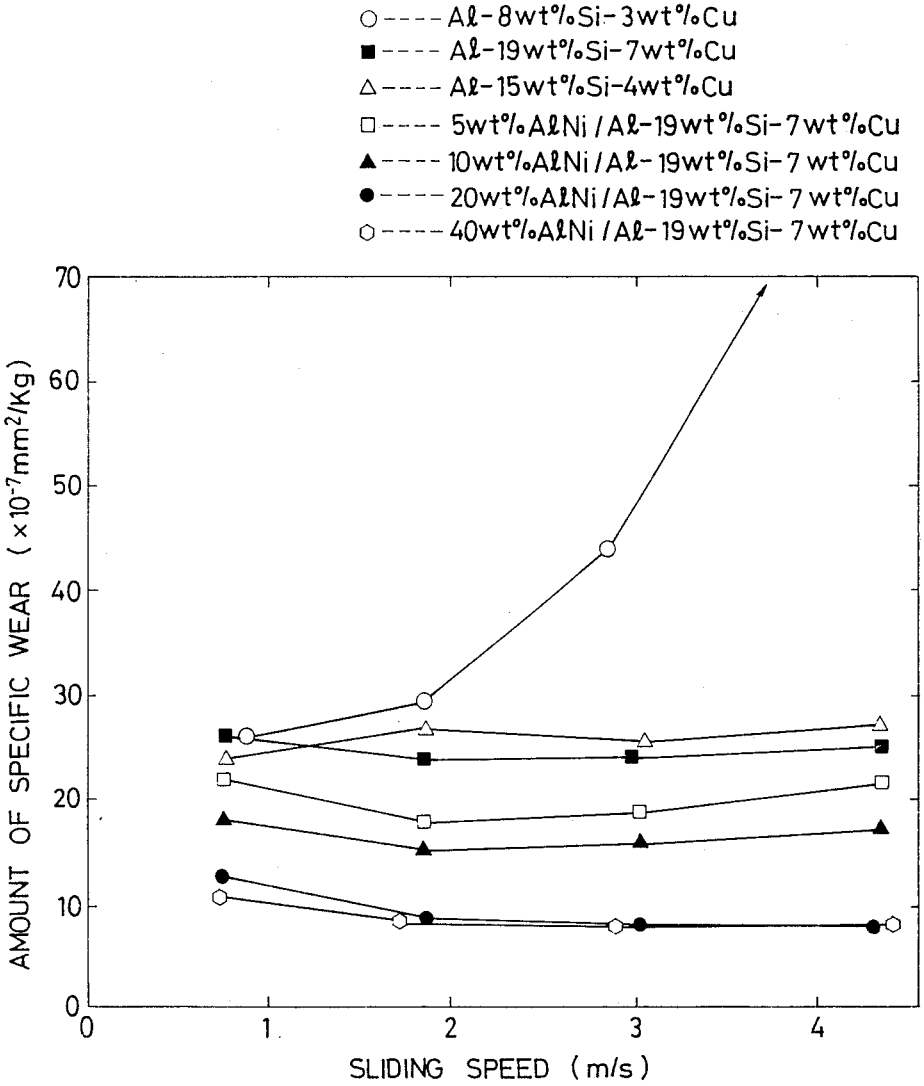

FIGS. 18, 19 and 20 are graphs plotting the amounts of specific wear (vertical axis) of the comparative samples and the samples of AlNi-dispersion hardened alloys of the present invention as a function of sliding speed (horizontal axis). All samples used an Al-8 wt% Si-3 wt% Cu (FIG. 18), Al-15 wt% Si-4 wt% Cu (FIG. 19), or Al-19 wt% Si-7 wt% Cu (FIG. 20) alloy as a matrix-forming mother alloy. The samples of the present invention were strengthened by dispersion of AlNi particles present in amounts of 5, 10, 20 and 40 wt%. The wear test was also conducted for the case where AlNi particles were added in amounts of 4 and 50 wt% but the results are not shown in FIGS. 18, 19 and 20 since the data for the addition of 50 wt% AlNi was the same as the results of the case where AlNi was added in an amount of 40 wt% whereas the data for the addition of 4 wt% AlNi was the same as the results of the case where 5 wt% AlNi was added.

As one can see from FIGS. 18, 19 and 20, the samples of the present invention strengthened by dispersion of AlNi particles in amounts of 5, 10, 20 and 40 wt% were more wear-resistant than the comparative samples which were solely made of the mother alloy, i.e., Al-8 wt% Si-3 wt% Cu, Al-15 wt% Si-4 wt% Cu, or Al-19 wt% Si-7 wt% Cu.

Figure 21:
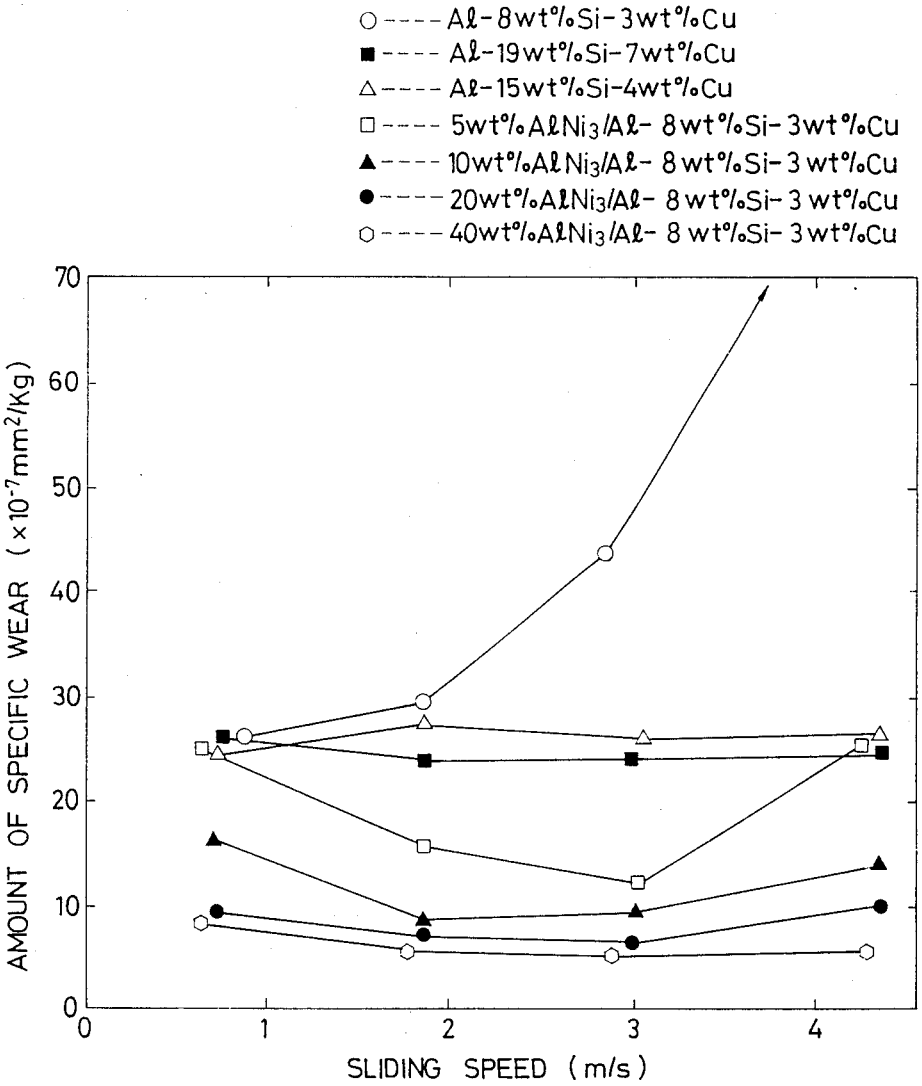
Figure 22:
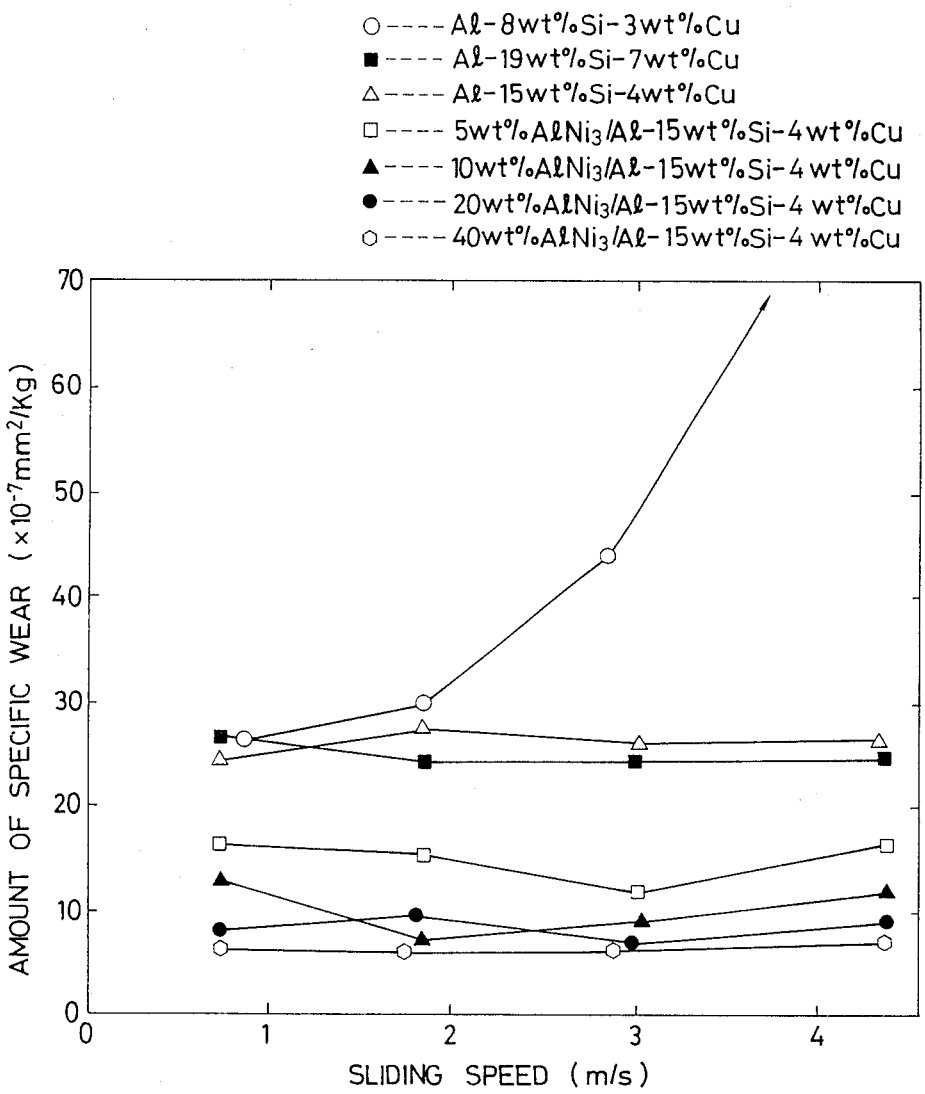
Figure 23:
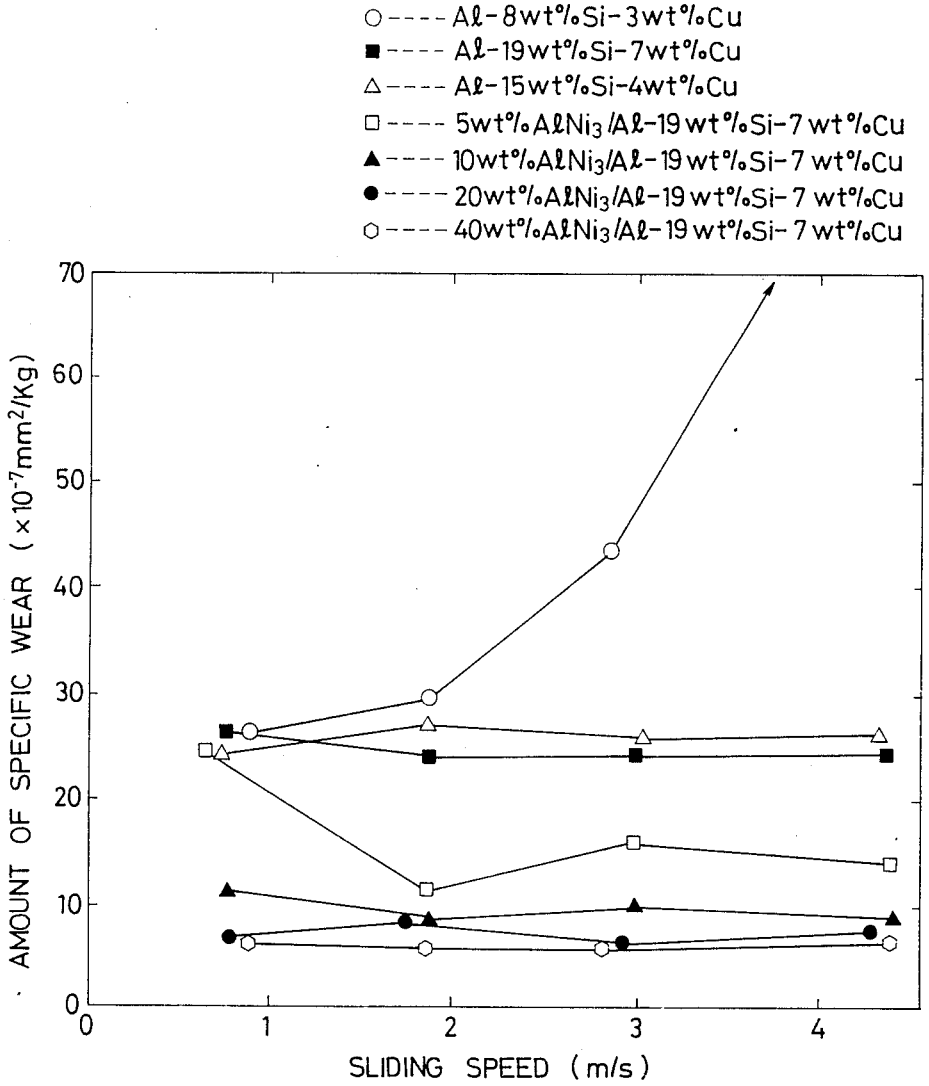

FIGS. 21, 22 and 23 are graphs plotting the amounts of specific wear (vertical axis) of the comparative samples and the samples of AlNi-dispersion hardened alloys of the present invention as a function of sliding speed (horizontal axis). All samples used an Al-8 wt% Si-3 wt% Cu (FIG. 21), Al-15 wt% Si-4 wt% Cu (FIG. 22), or Al-19 wt% Si-7 wt% Cu (FIG. 23) alloy as a matrix-forming mother alloy. The samples of the present invention were strengthened by dispersion of $AlNi_3$ particles present in amounts of 5, 10, 20 and 40 wt%. The wear test was also conducted for the case where $AlNi_3$ particles were added in amounts of 4 and 50 wt% but the results are not shown in FIGS. 21, 22 and 23 since the data for the addition of 50 wt% $AlNi_3$ was the same as the results of the case where $AlNi_3$ was added in an amount of 40 wt% whereas the data for the addition of 4 wt% $AlNi_3$ was the same as the results of the case where 5 wt% $AlNi_3$ was added.

As one can see from FIGS. 21, 22 and 23, the samples of the present invention strengthened by dispersion of $AlNi_3$ particles in amounts of 5, 10, 20 and 40 wt% were more wear-resistant than the comparative samples which were solely made of the mother alloy, i.e., Al-8 wt% Si-3 wt% Cu, Al-15 wt% Si-4 wt% Cu, or Al-19 wt% Si-7 wt% Cu.

Figure 24:
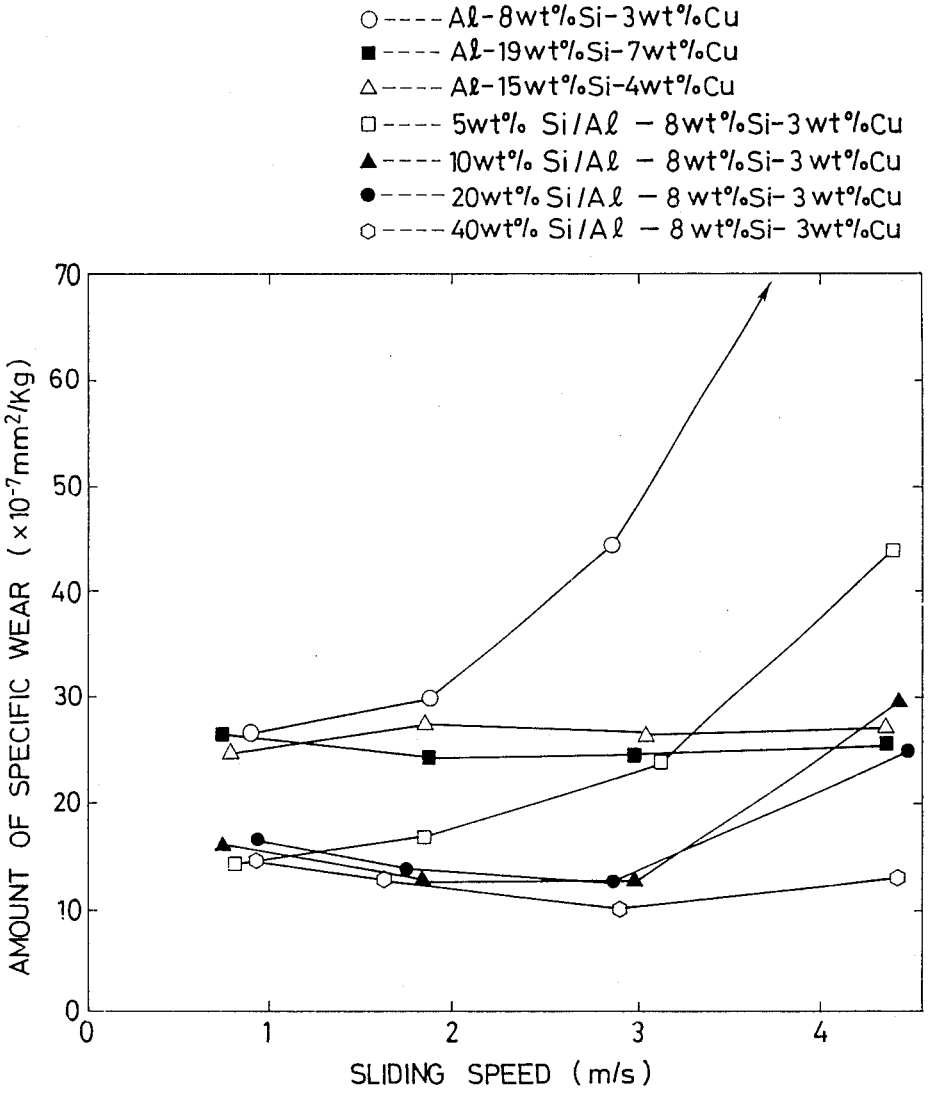
Figure 25:
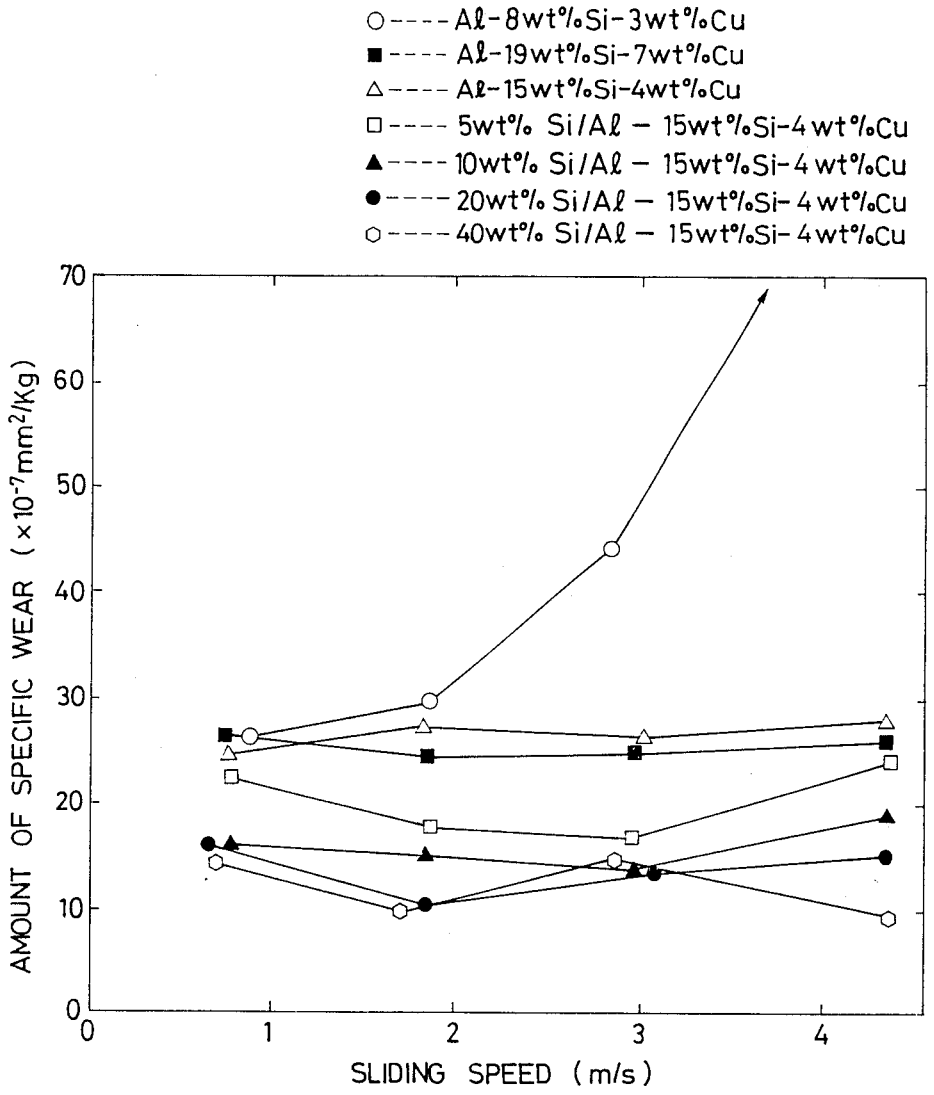
Figure 26:
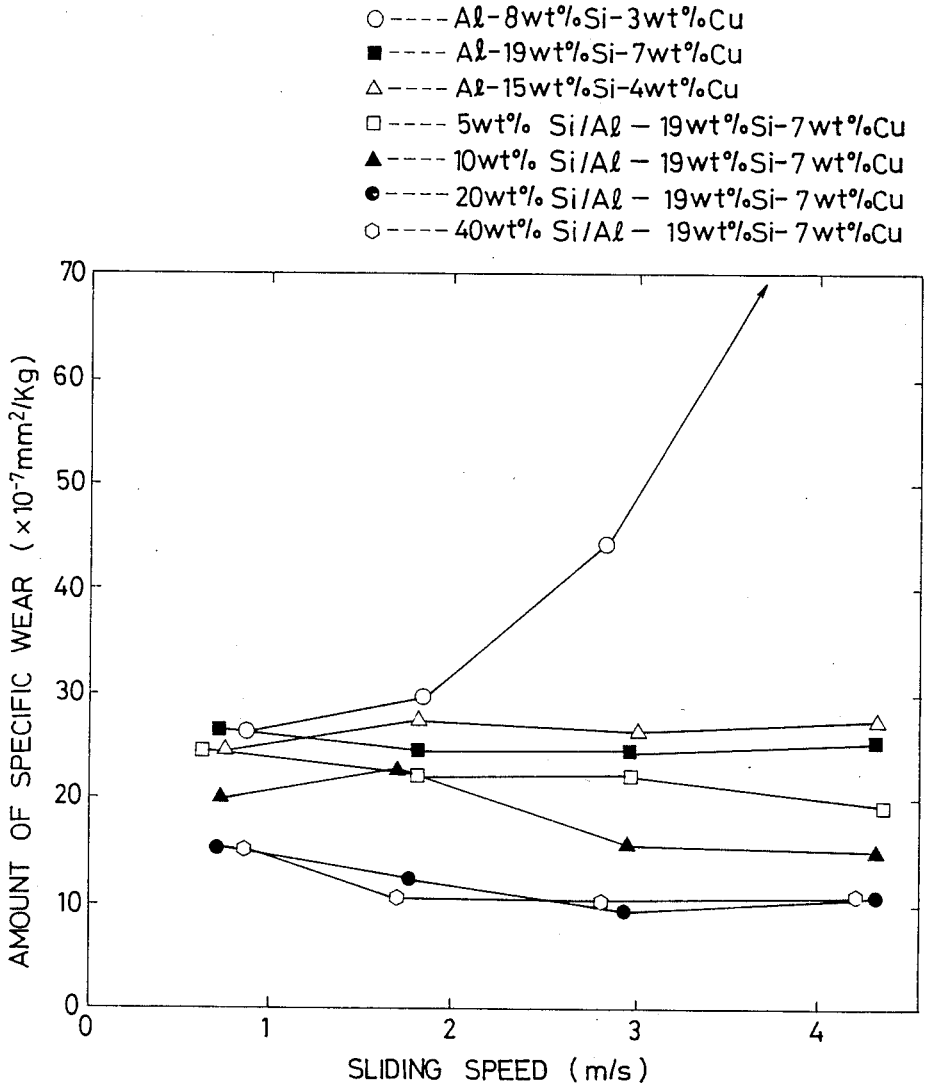

FIGS. 24, 25 and 26 are graphs plotting the amounts of specific wear (vertical axis) of the comparative samples and the samples of Si-dispersion hardened alloys of the present invention as a function of sliding speed (horizontal axis). All samples used an Al-8 wt% Si-3 wt% Cu (FIG. 24), Al-15 wt% Si-4 wt% Cu (FIG. 25), or Al-19 wt% Si-7 wt% Cu (FIG. 20) alloy as a matrix-forming mother alloy. The samples of the present invention were strengthened by dispersion of Si particles present in amounts of 5, 10, 20 and 40 wt%.

As one can see from FIGS. 24, 25 and 26, the samples of the present invention strengthened by dispersion of Si particles in amounts of 5, 10, 20 and 40 wt% were more-wear resistant than the comparative samples which were solely made of the mother alloy, i.e. Al-8 wt% Si-3 wt% Cu, Al-15 wt% Cu, or Al-19 wt% Si-7 wt% Cu.

The mechanical properties of four selected samples of the present invention that were strengthened by dispersion of AlNi, $Al_3Ni$, $AlNi_3$ and Si particle, respectively, were compared with those of three selected comparative samples, and the results are shown in Table 9.

Additional test speciments were prepared by adding AlNi, $Al_3Ni$, $AlNi_3$, or Si particles to a matrix-forming Al-20 wt% Si-9 wt% Cu alloy and subjected to tensile and wear testing under the same conditions as described above. The results were similar to those obtained with the samples prepared by adding AlNi, $Al_3Ni$, $AlNi_3$ or Si particles to the Al-19 wt% Si-7 wt% Cu alloy.

As will be understood from the foregoing description, the dispersion-hardened alloy of the present invention is characterized in that particles of Ni, Si or an Al-Ni base intermetallic compound are uniformly dispersed in a matrix formed of a mother alloy. This contributes improved wear resistance and ductility to the mother alloy, thereby providing it with superior mechanical properties.

According to the process of the present invention for producing such an improved dispersion-hardened alloy, powder of Ni, Si or an Al-Ni base intermetallic compound is added to the melt of a matrix-forming base mother alloy and, after the mixture is mechanically agitated for a short period of time, it is directly fed into a die-casting machine so as to disperse the added particles uniformly in the matrix. As a consequence, the added particles can be uniformly dispersed in the matrix without causing any undesired problems such as agglomeration and a dispersion-hardened alloy having improved wear resistance and ductility can be produced.

In addition, the process of the present invention which employs a die-casting technique is capable of producing a desired alloy without any of the costly surface treatments or oxidation-preventing methods or apparatus that have been required in the conventional techniques of powder metallurgy which are based on sintering. Because of this advantage, reduction in the processing cost. As a further advantage, the process of the present invention is capable of producing alloys of a complex shape in a reduced number of steps, thereby enabling large-scale production of dispersion-hardened alloys at low cost.

TABLE 1

| No. | Specimen | Sliding speed (m/sec) | Sliding distance (m) | Final load (kg) | Width of wear marks (mm) | Amount of specific wear ($\times 10^{-7}$ $mm^2/kg$) | Remarks |
|---|---|---|---|---|---|---|---|
| 1 | | 0.94 | 100 | 2.1 | 3.6 | 59.48 | Comparative example |
| 2 | Al - 6 wt % Ni - 5 wt % Mg | 1.96 | 100 | 2.1 | 2.4 | 28.81 | Comparative example |
| 3 | | 2.86 | 100 | 2.1 | 2.6 | 24.36 | Comparative example |
| 4 | | 4.36 | 100 | 2.1 | 3.2 | 39.46 | Comparative example |
| 5 | | 0.94 | 100 | 2.1 | 2.85 | 28.7 | Comparative example |
| 6 | 390 | 1.96 | 100 | 2.1 | 2.65 | 24.5 | Comparative example |
| 7 | | 2.86 | 100 | 2.1 | 2.6 | 24.36 | Comparative example |
| 8 | | 4.36 | 100 | 2.1 | 3.05 | 37.01 | Comparative example |
| 9 | | 0.94 | 100 | 2.1 | 2.65 | 23.5 | Comparative example |
| 10 | 5 wt % $Si_3N_4$/ADC10 | 1.96 | 100 | 2.1 | 2.35 | 19.0 | Comparative |

TABLE 1-continued

| No. | Specimen | Sliding speed (m/sec) | Sliding distance (m) | Final load (kg) | Width of wear marks (mm) | Amount of specific wear ($\times 10^{-7}$ mm$^2$/kg) | Remarks |
|---|---|---|---|---|---|---|---|
| | | | | | | | example |
| 11 | | 2.86 | 100 | 2.1 | 2.55 | 20.01 | Comparative example |
| 12 | | 4.36 | 100 | 2.1 | 2.4 | 18.53 | Comparative example |
| 13 | | 0.94 | 100 | 2.1 | 2.9 | 29.13 | Present invention |
| 14 | 3 wt % AlNi/ | 1.96 | 100 | 2.1 | 2.7 | 24.78 | Present invention |
| 15 | Al - 6 wt % Ni - 5 wt % Mg | 2.86 | 100 | 2.1 | 2.5 | 19.94 | Present invention |
| 16 | | 4.36 | 100 | 2.1 | 3.7 | 37.01 | Present invention |
| 17 | | 0.94 | 100 | 2.1 | 2.5 | 18.61 | Present invention |
| 18 | 5 wt % AlNi/ | 1.96 | 100 | 2.1 | 2.3 | 14.56 | Present invention |
| 19 | Al - 6 wt % Ni - 5 wt % Mg | 2.86 | 100 | 2.1 | 2.5 | 18.61 | Present invention |
| 20 | | 4.36 | 100 | 2.1 | 3.1 | 34.02 | Present invention |
| 21 | | 0.94 | 100 | 2.1 | 2.4 | 17.53 | Present invention |
| 22 | 7 wt % AlNi/ | 1.96 | 100 | 2.1 | 2.4 | 17.53 | Present invention |
| 23 | Al - 6 wt % Ni - 5 wt % Mg | 2.86 | 100 | 2.1 | 2.2 | 14.06 | Present invention |
| 24 | | 4.36 | 100 | 2.1 | 3.1 | 36.46 | Present invention |
| 25 | | 0.94 | 100 | 2.1 | 2.3 | 14.48 | Present invention |
| 26 | 10 wt % AlNi/ | 1.96 | 100 | 2.1 | 2.4 | 16.57 | Present invention |
| 27 | Al - 6 wt % Ni - 5 wt % Mg | 2.86 | 100 | 2.1 | 2.5 | 19.76 | Present invention |
| 28 | | 4.36 | 100 | 2.1 | 2.9 | 31.22 | Present invention |
| 29 | | 0.94 | 100 | 2.1 | 2.2 | 13.58 | Present invention |
| 30 | 15 wt % AlNi/ | 1.96 | 100 | 2.1 | 2.2 | 13.58 | Present invention |
| 31 | Al - 6 wt % Ni - 5 wt % Mg | 2.86 | 100 | 2.1 | 2.4 | 17.71 | Present invention |
| 32 | | 4.36 | 100 | 2.1 | 3.1 | 24.81 | Present invention |
| 33 | | 0.94 | 100 | 2.1 | 2.2 | 13.58 | Present invention |
| 34 | 20 wt % AlNi/ | 1.96 | 100 | 2.1 | 2.1 | 11.85 | Present invention |
| 35 | Al - 6 wt % Ni - 5 wt % Mg | 2.86 | 100 | 2.1 | 2.4 | 16.54 | Present invention |
| 36 | | 4.36 | 100 | 2.1 | 2.7 | 23.81 | Present invention |
| 37 | | 0.94 | 100 | 2.1 | 2.1 | 11.85 | Present invention |
| 38 | 30 wt % AlNi/ | 1.96 | 100 | 2.1 | 2.2 | 12.67 | Present invention |
| 39 | Al 6 wt % Ni - 5 wt % Mg | 2.86 | 100 | 2.1 | 2.5 | 18.61 | Present invention |
| 40 | | 4.36 | 100 | 2.1 | 2.9 | 29.03 | Present invention |
| 41 | | 0.94 | 100 | 2.1 | 2.2 | 11.85 | Present invention |
| 42 | 40 wt % AlNi/ | 1.96 | 100 | 2.1 | 2.2 | 11.85 | Present invention |
| 43 | Al - 6 wt % Ni - 5 wt % Mg | 2.86 | 100 | 2.1 | 2.4 | 16.54 | Present invention |
| 44 | | 4.36 | 100 | 2.1 | 2.9 | 29.03 | Present invention |

TABLE 2

| No. | Specimen | Sliding speed (m/sec) | Sliding distance (m) | Final load (kg) | Width of wear marks (mm) | Amount of specific wear ($\times 10^{-7}$ mm$^2$/kg) | Remarks |
|---|---|---|---|---|---|---|---|
| 1 | | 0.94 | 100 | 2.1 | 3.75 | 63.61 | Comparative example |

TABLE 2-continued

| No. | Specimen | Sliding speed (m/sec) | Sliding distance (m) | Final load (kg) | Width of wear marks (mm) | Amount of specific wear ($\times 10^{-7}$ mm$^2$/kg) | Remarks |
|---|---|---|---|---|---|---|---|
| 2 | Al - 6 wt % Ni | 1.96 | 100 | 2.1 | 4.05 | 79.12 | Comparative example |
| 3 | | 2.86 | 100 | 2.1 | 3.85 | 68.25 | Comparative example |
| 4 | | 4.36 | 100 | 2.1 | 4.65 | 119.74 | Comparative example |
| 5 | | 0.94 | 100 | 2.1 | 4.3 | 96.03 | Present invention |
| 6 | 3 wt % AlNi/ | 1.96 | 100 | 2.1 | 4.05 | 79.12 | Present invention |
| 7 | Al - 6 wt % Ni | 2.86 | 100 | 2.1 | 3.6 | 55.67 | Present invention |
| 8 | | 4.36 | 100 | 2.1 | 4.25 | 92.34 | Present invention |
| 9 | | 0.94 | 100 | 2.1 | 4.45 | 104.95 | Present invention |
| 10 | 5 wt % AlNi/ | 1.96 | 100 | 2.1 | 4.15 | 85.12 | Present invention |
| 11 | Al - 6 wt % Ni | 2.86 | 100 | 2.1 | 3.55 | 53.29 | Present invention |
| 12 | | 4.36 | 100 | 2.1 | 3.95 | 73.41 | Present invention |
| 13 | | 0.94 | 100 | 2.1 | 4.1 | 82.05 | Present invention |
| 14 | 7 wt % AlNi/ | 1.96 | 100 | 2.1 | 4.0 | 76.19 | Present invention |
| 15 | Al - 6 wt % Ni | 2.86 | 100 | 2.1 | 3.7 | 60.43 | Present invention |
| 16 | | 4.36 | 100 | 2.1 | 4.651 | 118.8 | Present invention |
| 17 | | 0.94 | 100 | 2.1 | 4.2 | 88.8 | Present invention |
| 18 | 10 wt % AlNi/ | 1.96 | 100 | 2.1 | 4.1 | 82.19 | Present invention |
| 19 | Al - 6 wt % Ni | 2.86 | 100 | 2.1 | 4.0 | 77.19 | Present invention |
| 20 | | 4.36 | 100 | 2.1 | 4.2 | 88.81 | Present invention |
| 21 | | 0.94 | 100 | 2.1 | 3.1 | 35.58 | Present invention |
| 22 | 15 wt % AlNi/ | 1.96 | 100 | 2.1 | 3.45 | 48.92 | Present invention |
| 23 | Al - 6 wt % Ni | 2.86 | 100 | 2.1 | 3.5 | 51.04 | Present invention |
| 24 | | 4.36 | 100 | 2.1 | 4.0 | 76.19 | Present invention |
| 25 | | 0.94 | 100 | 2.1 | 3.5 | 51.04 | Present invention |
| 26 | 20 wt % AlNi/ | 1.96 | 100 | 2.1 | 3.65 | 57.92 | Present invention |
| 27 | Al - 6 wt % Ni | 2.86 | 100 | 2.1 | 3.95 | 73.41 | Present invention |
| 28 | | 4.36 | 100 | 2.1 | 5.0 | 148.81 | Present invention |
| 29 | | 0.94 | 100 | 2.1 | 3.25 | 40.89 | Present invention |
| 30 | 30 wt % AlNi/ | 1.96 | 100 | 2.1 | 3.7 | 60.43 | Present invention |
| 31 | Al - 6 wt % Ni | 2.86 | 100 | 2.1 | 3.85 | 68.26 | Present invention |
| 32 | | 4.36 | 100 | 2.1 | 5.75 | 227.60 | Present invention |
| 33 | | 0.94 | 100 | 2.1 | 3.25 | 40.86 | Present invention |
| 34 | 40 wt % AlNi/ | 1.96 | 100 | 2.1 | 3.6 | 55.67 | Present invention |
| 35 | Al - 6 wt % Ni | 2.86 | 100 | 2.1 | 4.0 | 76.19 | Present invention |
| 36 | | 4.36 | 100 | 2.1 | 5.85 | 240.89 | Present invention |

TABLE 2a

| No. | Specimen | Sliding speed (m/sec) | Sliding distance (m) | Final load (kg) | Width of wear marks (mm) | Amount of specific wear ($\times 10^{-7}$ mm$^2$/kg) | Remarks |
|---|---|---|---|---|---|---|---|
| 1 | | 0.94 | 100 | 2.1 | 3.6 | 59.48 | Comparative |

TABLE 2a-continued

| No. | Specimen | Sliding speed (m/sec) | Sliding distance (m) | Final load (kg) | Width of wear marks (mm) | Amount of specific wear ($\times 10^{-7}$ mm$^2$/kg) | Remarks |
|---|---|---|---|---|---|---|---|
| | | | | | | | example |
| 2 | Al - 6 wt % Ni - 5 wt % Mg | 1.96 | 100 | 2.1 | 2.4 | 28.81 | Comparative example |
| 3 | | 2.86 | 100 | 2.1 | 2.6 | 24.36 | Comparative example |
| 4 | | 4.36 | 100 | 2.1 | 3.2 | 39.46 | Comparative example |
| 5 | | 0.94 | 100 | 2.1 | 2.85 | 28.7 | Comparative example |
| 6 | 390 | 1.96 | 100 | 2.1 | 2.65 | 24.5 | Comparative example |
| 7 | | 2.86 | 100 | 2.1 | 2.6 | 24.36 | Comparative example |
| 8 | | 4.36 | 100 | 2.1 | 3.05 | 37.01 | Comparative example |
| 9 | | 0.94 | 100 | 2.1 | 2.87 | 28.29 | Present invention |
| 10 | 3 wt % Ni/ | 1.96 | 100 | 2.1 | 2.68 | 23.07 | Present invention |
| 11 | Al - 6 wt % Ni - 5 wt % Mg | 2.86 | 100 | 2.1 | 3.09 | 35.35 | Present invention |
| 12 | | 4.36 | 100 | 2.1 | 3.20 | 42.01 | Present invention |
| 13 | | 0.94 | 100 | 2.1 | 2.19 | 12.59 | Present invention |
| 14 | 5 wt % Ni/ | 1.96 | 100 | 2.1 | 2.09 | 11.32 | Present invention |
| 15 | Al - 6 wt % Ni - 5 wt % Mg | 2.86 | 100 | 2.1 | 2.71 | 24.25 | Present invention |
| 16 | | 4.36 | 100 | 2.1 | 3.19 | 41.08 | Present invention |
| 17 | | 0.94 | 100 | 2.1 | 2.88 | 28.44 | Present invention |
| 18 | 7 wt % Ni/ | 1.96 | 100 | 2.1 | 3.03 | 33.23 | Present invention |
| 19 | Al - 6 wt % Ni - 5 wt % Mg | 2.86 | 100 | 2.1 | 3.58 | 55.2 | Present invention |
| 20 | | 4.36 | 100 | 2.1 | 3.70 | 61.2 | Present invention |
| 21 | | 0.94 | 100 | 2.1 | 2.3 | 8.82 | Present invention |
| 22 | 10 wt % Ni/ | 1.96 | 100 | 2.1 | 2.4 | 20.43 | Present invention |
| 23 | Al - 6 wt % Ni - 5 wt % Mg | 2.86 | 100 | 2.1 | 2.5 | 22.03 | Present invention |
| 24 | | 4.36 | 100 | 2.1 | 2.9 | 32.22 | Present invention |
| 25 | | 0.94 | 100 | 2.1 | 3.03 | 33.98 | Present invention |
| 26 | 20 wt % Ni/ | 1.96 | 100 | 2.1 | 2.37 | 28.35 | Present invention |
| 27 | Al - 6 wt % Ni - 5 wt % Mg | 2.86 | 100 | 2.1 | 2.76 | 25.16 | Present invention |
| 28 | | 4.36 | 100 | 2.1 | 2.76 | 25.09 | Present invention |
| 29 | | 0.94 | 100 | 2.1 | 3.13 | 36.78 | Present invention |
| 30 | 30 wt % Ni/ | 1.96 | 100 | 2.1 | 3.10 | 32.21 | Present invention |
| 31 | Al - 6 wt % Ni - 5 wt % Mg | 2.86 | 100 | 2.1 | 2.78 | 25.9 | Present invention |
| 32 | | 4.36 | 100 | 2.1 | 3.57 | 57.65 | Present invention |
| 33 | | 0.94 | 100 | 2.1 | 3.0 | 32.21 | Present invention |
| 34 | 40 wt % Ni/ | 1.96 | 100 | 2.1 | 3.13 | 36.78 | Present invention |
| 35 | Al - 6 wt % Ni - 5 wt % Mg | 2.86 | 100 | 2.1 | 3.21 | 42.01 | Present invention |
| 36 | | 4.36 | 100 | 2.1 | 3.78 | 64.6 | Present invention |

TABLE 3

| No. | Sample | Average diameter of dispersion particles (μm) | 0.2% Proof stress (kgf/mm²) | Tensile strength (%) | Elongation (HRB) | Hardness Remarks | |
|---|---|---|---|---|---|---|---|
| 1 | 10 wt % AlNi/Al—Ni—Mg | 44 | 20.2 | 29.0 | 3.6~5.0 | 58 | Present invention |
| 2 | 10 wt % AlNi/Al—Ni | 44 | 15.8 | 25.0 | 8.4 | 20 | Present invention |
| 3 | 20 wt % Ni/Al—Ni—Mg | 44 | 18.0 | 28.0 | 4.0 | 53 | Present invention |
| 4 | 5 wt % $Si_3N_4$/ADC10 | 44 | 23.7 | 32.6 | 0.7 | 65.2 | Comparative example |
| 5 | 10 wt % SiC/ADC10 | 44 | 17.2 | 27.2 | 0.7 | 64.1 | Comparative example |
| 6 | ADC10 | — | 17.0 | 32.0 | 3.5 | 35~50 | Comparative example |

Note:
Al—Ni—Mg=Al - 6 wt % Ni - 5 wt % Mg
Al—Ni=Al - 6 wt % Ni

TABLE 4

| Sample | Chemical Component (wt %) | | | | | | | | |
|---|---|---|---|---|---|---|---|---|---|
| | Cu | Si | Mg | Zn | Fe | Mn | Ni | Sn | Al |
| ADC10 | 2.0~4.0 | 7.5~9.5 | <0.3 | <1.0 | <1.3 | <0.5 | <0.5 | <0.3 | remainder |
| 390 | 2.0~4.0 | 16~18 | <0.5 | <1.0 | <1.3 | <0.5 | <0.5 | <0.3 | remainder |
| Matrix of the present invention | — | — | 5 | <1.0 | <1.3 | <0.5 | 6 | <0.3 | remainder |
| Matrix of the present invention | — | — | — | — | — | — | 6 | — | remainder |

TABLE 5

| Dispersion particle | $Al_3Ni$ | $Al_3Ni_2$ | AlNi | $AlNi_3$ | Si |
|---|---|---|---|---|---|
| hardness | 450 | 900 | 800 | 450 | 1100 |

TABLE 5-continued

| Dispersion particle | $Al_3Ni$ | $Al_3Ni_2$ | AlNi | $AlNi_3$ | Si |
|---|---|---|---|---|---|
| (Hv) | | | | | |

TABLE 6

Sample; 390, Al - 6 wt % Ni - 5 wt % Mg, 5 wt % $Si_3N_4$/ADC10,
10 wt % AlNi/Al - 5.7~6.0 wt % Ni - 5.0~6.0 wt % Mg,
10 wt % AlNi/Al - 5.7 6.0 wt % Ni
Material of standard rotary disc; FC 25

| No. | Specimen | Sliding speed (m/sec) | Sliding distance (m) | Final load (kg) | Width of wear marks (mm) | Amount of specific wear ($\times 10^{-7}$ mm²/kg) | Remarks |
|---|---|---|---|---|---|---|---|
| 1 | 390 | 0.94 | 200 | 2.1 | 3.8 | 32.7 | Comparative example |
| 2 | " | 1.96 | 200 | 2.1 | 4.0 | 38.1 | Comparative example |
| 3 | " | 2.86 | 200 | 2.1 | 3.5 | 25.5 | Comparative example |
| 4 | " | 4.36 | 200 | 2.1 | 3.3 | 19.5 | Comparative example |
| 5 | Al - 6 wt % Ni - 5 wt % Mg | 0.94 | 200 | 2.1 | 4.6 | 57.9 | Comparative example |
| 6 | " | 1.96 | 200 | 2.1 | 4.0 | 38.1 | Comparative example |
| 7 | " | 2.86 | 200 | 2.1 | 4.1 | 41.1 | Comparative example |
| 8 | " | 4.36 | 200 | 2.1 | 5.8 | 116.0 | Comparative example |
| 9 | 5 wt % $Si_3N_4$/ADC10 | 0.94 | 200 | 2.1 | 2.5 | 9.3 | Comparative example |
| 10 | " | 1.94 | 200 | 2.1 | 3.1 | 17.7 | Comparative example |
| 11 | " | 2.86 | 200 | 2.1 | 4.0 | 38.1 | Comparative example |
| 12 | " | 4.36 | 200 | 2.1 | 3.9 | 35.3 | Comparative example |
| 13 | 10 wt % AlNi/Al - 5.7~6.0 wt % Ni - 5.0~6.0 wt % Mg | 0.94 | 200 | 2.1 | 2.2 | 5.5 | Present invention |
| 14 | 10 wt % AlNi/Al - 5.7~6.0 wt % Ni - 5.0~6.0 wt % Mg | 1.94 | 200 | 2.1 | 3.8 | 32.6 | Present invention |

TABLE 6-continued

Sample; 390, Al - 6 wt % Ni - 5 wt % Mg, 5 wt % $Si_3N_4$/ADC10, 10 wt % AlNi/Al - 5.7~6.0 wt % Ni - 5.0~6.0 wt % Mg, 10 wt % AlNi/Al - 5.7 6.0 wt % Ni
Material of standard rotary disc; FC 25

| No. | Specimen | Sliding speed (m/sec) | Sliding distance (m) | Final load (kg) | Width of wear marks (mm) | Amount of specific wear ($\times 10^{-7}$ $mm^2/kg$) | Remarks |
|---|---|---|---|---|---|---|---|
| 15 | 10 wt % AlNi/Al - 5.7~6.0 wt % Ni - 5.0~6.0 wt % Mg | 2.86 | 200 | 2.1 | 4.0 | 38.1 | Present invention |
| 16 | 10 wt % AlNi/Al - 5.7~6.0 wt % Ni - 5.0~6.0 wt % Mg | 4.36 | 200 | 2.1 | 2.2 | 6.3 | Present invention |
| 17 | 10 wt % AlNi/Al - 5.7~6.0 wt % Ni | 0.94 | 200 | 2.1 | 2.6 | 8.8 | Present invention |
| 18 | 10 wt % AlNi/Al - 5.7~6.0 wt % Ni | 1.96 | 200 | 2.1 | 3.4 | 22.8 | Present invention |
| 19 | 10 wt % AlNi/Al - 5.7~6.0 wt % Ni | 2.86 | 200 | 2.1 | 3.9 | 33.0 | Present invention |
| 20 | 10 wt % AlNi/Al - 5.7~6.0 wt % Ni | 4.36 | 200 | 2.1 | 3.1 | 18.0 | Present invention |

TABLE 7

Sample; 390, Al - 6 wt % Ni - 5 wt % Mg, 5 wt % $Si_3N_4$/ADC10, 10 wt % AlNi/Al - 5.7~6.0 wt % Ni - 5.0~6.0 wt % Mg, 10 wt % AlNi/Al - 5.7 6.0 wt % Ni
Material of standard rotary disc; SUJ 2

| No. | Specimen | Sliding speed (m/sec) | Sliding distance (m) | Final load (kg) | Width of wear marks (mm) | Amount of specific wear ($\times 10^{-7}$ $mm^2/kg$) | Remarks |
|---|---|---|---|---|---|---|---|
| 1 | 390 | 0.94 | 200 | 2.1 | 4.1 | 41.0 | Comparative example |
| 2 | " | 1.96 | 200 | 2.1 | 3.3 | 21.4 | Comparative example |
| 3 | " | 2.86 | 200 | 2.1 | 4.4 | 50.7 | Comparative example |
| 4 | " | 4.36 | 200 | 2.1 | 4.1 | 41.0 | Comparative example |
| 5 | Al - 6 wt % Ni - 5 wt % Mg | 0.94 | 200 | 2.1 | 2.7 | 11.7 | Comparative example |
| 6 | " | 1.96 | 200 | 2.1 | 3.3 | 21.4 | Comparative example |
| 7 | " | 2.86 | 200 | 2.1 | 4.2 | 41.1 | Comparative example |
| 8 | " | 4.36 | 200 | 2.1 | 5.9 | 122.2 | Comparative example |
| 9 | 5 wt % $Si_3N_4$/ADC10 | 0.94 | 200 | 2.1 | 2.3 | 7.3 | Comparative example |
| 10 | " | 1.96 | 200 | 2.1 | 3.6 | 27.7 | Comparative example |
| 11 | " | 2.88 | 200 | 2.1 | 3.7 | 30.2 | Comparative example |
| 12 | " | 4.36 | 200 | 2.1 | 3.2 | 19.5 | Comparative example |
| 13 | 10 wt % AlNi/Al - 5.7~6.0 wt % Ni - 5.0~6.0 wt % Mg | 0.94 | 200 | 2.1 | 2.2 | 6.3 | Present invention |
| 14 | 10 wt % AlNi/Al - 5.7~6.0 wt % Ni - 5.0~6.0 wt % Mg | 1.96 | 200 | 2.1 | 3.2 | 19.5 | Present invention |
| 15 | 10 wt % AlNi/Al - 5.7~6.0 wt % Ni - 5.0~6.0 wt % Mg | 2.86 | 200 | 2.1 | 3.8 | 32.7 | Present invention |
| 16 | 10 wt % AlNi/Al - 5.7~6.0 wt % Ni - 5.0~6.0 wt % Mg | 4.36 | 200 | 2.1 | 2.2 | 6.3 | Present invention |
| 17 | 10 wt % AlNi/Al - 5.7~6.0 wt % Ni | 0.94 | 200 | 2.1 | 2.8 | 12.0 | Present invention |
| 18 | 10 wt % AlNi/Al - 5.7~6.0 wt % Ni | 1.94 | 200 | 2.1 | 3.7 | 27.0 | Present invention |
| 19 | 10 wt % AlNi/Al - 5.7~6.0 wt % Ni | 2.86 | 200 | 2.1 | 3.9 | 34.3 | Present invention |
| 20 | 10 wt % AlNi/Al - 5.7~6.0 wt % Ni | 4.36 | 200 | 2.1 | 3.2 | 18.5 | Present invention |

TABLE 8

| Sample | Chemical Component (wt %) | | | | | | | | | |
|---|---|---|---|---|---|---|---|---|---|---|
| | Si | Cu | Fe | Zn | Mg | Mn | Ni | T | Sn | Al |
| Comparative example 1 and matrix of the present | 7.5~9.5 | 2.0~4.0 | <1.3 | <1.0 | <0.3 | <0.5 | <0.5 | <0.01 | <0.3 | remainder |

TABLE 8-continued

| Sample | Chemical Component (wt %) | | | | | | | | | |
|---|---|---|---|---|---|---|---|---|---|---|
| | Si | Cu | Fe | Zn | Mg | Mn | Ni | T | Sn | Al |
| invention | | | | | | | | | | |
| Comparative example 2 and matrix of the present invention | 14.5~15.5 | 4.0~4.5 | <1.3 | <1.0 | <0.5 | <0.5 | <0.5 | <0.06 | <0.3 | remainder |
| Comparative example 3 and matrix of the present invention | 17~19 | 4.5~5.5 | <1.3 | <1.0 | <0.5 | <0.5 | <0.5 | <0.04 | <0.3 | remainder |

TABLE 9

| No. | Sample | Average diameter of dispersion particles (μm) | 0.2% Proof stress (kgf/mm²) | Tensile strength (%) | Elongation (HRB) | Hardness Remarks | |
|---|---|---|---|---|---|---|---|
| 1 | 10 wt % $Al_3Ni$/Al—Si—Cu | 20 | 15.5 | 30 | 3 | 48 | Present invention |
| 2 | 10 wt % AlNi/Al—Si—Cu | 44 | 15.5 | 31 | 3 | 49 | Present invention |
| 3 | 10 wt % $AlNi_3$/Al—Si—Cu | 30 | 20.0 | 33 | 4 | 50 | Present invention |
| 4 | 10 wt % Si/Al—Si—Cu | 30 | 15.5 | 31 | 2.5 | 65 | Present invention |
| 5 | Al - 8 wt % Si - 3 wt % Cu | | 14.0 | 32 | 5 | 47 | Comparative invention |
| 6 | Al - 15 wt % Si - 4 wt % Cu | | 20.0 | 28 | 0.9 | 71 | Comparative invention |
| 7 | Al - 19 wt % Si - 7 wt % Cu | | 21.0 | 28 | 0.8 | 72 | Comparative invention |

Note: Al—Si—Cu=Al - 8 wt % Si-3 wt % Cu

What is claimed is:

1. A dispersion-hardened alloy comprising:

a matrix consisting essentially of a material selected from the group consisting of Al-(3.5-8.0) wt% Ni alloys and Al-(3.5-8.0) wt% Ni-(3.0-8.0) wt% Mg alloys; and strengthening particles dispersed uniformly in said matrix, said particles being particles of Ni or particles of at least one intermetallic compound selected from the group consisting of AlNi, $Al_3Ni$, $Al_3Ni_2$, and $AlNi_3$, said particles being incorporated in an amount of about 10 to about 50 wt%.

2. The dispersion-hardened alloy according to claim 1, wherein the strengthening particles dispersed uniformly in said matrix have an average particle size of no greater than about ab 100 μm, and the dispersion-hardened alloy has improved wear resistance while maintaining approximately the same ductility as said matrix material.

3. The dispersion-hardened alloy of claim 1, wherein said strengthening particles are incorporated in an amount of about 10 to about 20 wt%.

4. The dispersion-hardened alloy according to claim 3, wherein the strengthening particles dispersed uniformly in said matrix have an average particle size of no greater than about 100 μm, and the dispersion-hardened alloy has improved wear resistance while maintaining approximately the same ductility as said matrix material.

5. A dispersion-hardened alloy comprising:

a matrix comprised of an Al-Ni base alloy; and strengthening particles dispersed uniformly in said matrix, said particles being particles of Ni or particles of at least one intermetallic compound selected from the group consisting of AlNi, $Al_3Ni$, $Al_3Ni_2$, and $AlNi_3$, said particles being incorporated in an amount of about 10 to about 20 wt%.

6. The dispersion-hardened alloy according to claim 5, wherein the strengthening particles dispersed uniformly in said matrix have an average particle size of no greater than about 100 μm, and the dispersion-hardened alloy has improved wear resistance while maintaining approximately the same ductility as said matrix material.

7. A dispersion-hardened alloy formed by a process comprising the steps of:

providing a melt of an Al-Ni base alloy;

adding directly to said melt strengthening particles of Ni or strengthening particles of at least one intermetallic compound selected from the group consisting of AlNi, $Al_3Ni$, $Al_3Ni_2$, and $AlNi_3$;

agitating said melt to mix said particles in said melt without dissolving said particles; and die-casting the resulting mixture to form a structure in which said particles of Ni or said particles of at least one intermetallic compound are uniformly dispersed in a matrix formed of said Al-Ni base alloy.

8. The dispersion-hardened alloy according to claim 7, wherein about 3 wt.% to about 50 wt.% of said strengthening particles of Ni or said strengthening particles of said at least one intermetallic compound are added directly to said melt, the dispersion-hardened alloy having improved wear resistance while maintaining approximately the same ductility as the Al-Ni base alloy matrix material.

9. The dispersion-hardened alloy according to claim 8, wherein about 5 wt.% to about 20 wt.% of said strengthening particles of Ni or said strengthening particles of said at least one intermetallic compound are added directly to said melt.

10. The dispersion-hardened alloy according to claim 8, wherein said melt is at a temperature in the range from about 640° C. to about 800° C.

11. The dispersion-hardened alloy according to claim 8, wherein said melt is at a temperature in the range from about 670° C. to about 730° C.

12. The dispersion-hardened alloy according to claim 10, wherein said melt is agitated for about 5 to about 60 seconds.

* * * * *